US011867015B2

(12) United States Patent
Trinh et al.

(10) Patent No.: US 11,867,015 B2
(45) Date of Patent: Jan. 9, 2024

(54) DOWNHOLE FRICTION REDUCTION SYSTEMS

(71) Applicant: National Oilwell Varco, L.P., Houston, TX (US)

(72) Inventors: Khoi Trinh, Spring, TX (US); Yufang Xia, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 33 days.

(21) Appl. No.: 17/686,674

(22) Filed: Mar. 4, 2022

(65) Prior Publication Data

US 2022/0282588 A1 Sep. 8, 2022

Related U.S. Application Data

(60) Provisional application No. 63/156,763, filed on Mar. 4, 2021.

(51) Int. Cl.
*E21B 31/00* (2006.01)
*E21B 34/10* (2006.01)

(52) U.S. Cl.
CPC ..... *E21B 31/005* (2013.01); *E21B 34/10* (2013.01)

(58) Field of Classification Search
CPC ..... E21B 31/005; E21B 34/10
See application file for complete search history.

(56) References Cited

U.S. PATENT DOCUMENTS 4,361,193 A * 11/1982 Gravley ..... E21B 7/04 175/320
4,633,958 A * 1/1987 Mouton ..... E21B 21/00 175/324
2016/0305188 A1* 10/2016 Hay ..... E21B 21/10
2019/0024459 A1* 1/2019 Sicilian ..... E21B 6/04

* cited by examiner

*Primary Examiner* — D. Andrews
(74) *Attorney, Agent, or Firm* — Conley Rose, P.C.

(57) ABSTRACT

A friction reduction system includes a housing including a central axis and a central passage, a valve disposed in the housing and including a first valve body and a second valve body wherein the first valve body is permitted to rotate relative to the second valve body, and a mandrel coupled to the second valve body and permitted to travel axially relative to the housing, wherein a first net pressure force is applied against the mandrel that corresponds to a drilling fluid pressure of a drilling fluid in response to flowing the drilling fluid through the valve and transitioning the valve from a closed configuration to an open configuration, and wherein a second net pressure force is applied against the mandrel that corresponds to a wellbore fluid pressure in response to flowing the drilling fluid through the valve and transitioning the valve from the open configuration to the closed configuration.

31 Claims, 12 Drawing Sheets

DOWNHOLE FRICTION REDUCTION SYSTEMS

CROSS-REFERENCE TO RELATED APPLICATIONS

The present application claims benefit of U.S. provisional patent application No. 63/156,763 filed Mar. 4, 2021, entitled "Downhole Friction Reduction Systems," which are incorporated herein by reference in their entirety for all purposes.

STATEMENT REGARDING FEDERALLY SPONSORED RESEARCH OR DEVELOPMENT

Not applicable.

BACKGROUND

In drilling a wellbore into an earthen formation, such as for the recovery of hydrocarbons or minerals from a subsurface formation, it is typical practice to connect a drill bit onto the lower end of a drillstring formed from a plurality of pipe joints connected together end-to-end, and then rotate the drillstring so that the drill bit progresses downward into the earth to create a wellbore along a predetermined trajectory. In some applications, drilling fluid or "mud" is pumped under pressure down the drillstring, out the face of the drill bit into the wellbore, and then up the annulus between the drillstring and the wellbore sidewall to the surface. The drilling fluid, which may be water-based or oil-based, is typically viscous to enhance its ability to carry wellbore cuttings to the surface. Additionally, the drillstring may be connected to a bottomhole assembly (BHA) including a downhole mud motor configured to rotate drill bit in response to the pumping of the pressurized drilling fluid.

The drillstring may not be rotated from the surface in some instances when rotation of the drill bit is driven by the mud motor, and instead the drillstring may slide through the wellbore as the drill bit cuts into the formation. The drillstring may form what is referred to as a "mud cake" along a sidewall of the wellbore which provides a physical barrier between the wellbore and the earthen formation to reduce fluid loss to the earthen formation. Additionally, portions of the drillstring may occasionally "stick" a sidewall of the wellbore as the drillstring slides through the wellbore, undesirably increasing the amount of friction between the drillstring and the wellbore which may limit the "reach" or length of the wellbore. In some applications, the drillstring is provided with one or more friction reduction tools designed to reduce friction between the drillstring and the wellbore. The friction reduction tools may be configured to generate oscillating motion in the drillstring in response to periodically obstructing or choking the flow of drilling fluid to the BHA.

BRIEF SUMMARY

An embodiment of a friction reduction system deployable in a wellbore includes a housing comprising a central axis and a central passage, a valve disposed in the housing and comprising a first valve body and a second valve body wherein the first valve body is permitted to rotate relative to the second valve body, and a mandrel coupled to the second valve body and permitted to travel axially relative to the housing, wherein a first net pressure force is applied against the mandrel that corresponds to a drilling fluid pressure of a drilling fluid in response to flowing the drilling fluid through the valve and transitioning the valve from a closed configuration to an open configuration, and wherein a second net pressure force is applied against the mandrel that corresponds to a wellbore fluid pressure in response to flowing the drilling fluid through the valve and transitioning the valve from the open configuration to the closed configuration. In some embodiments, the valve is configured to stroke the mandrel in a first axial direction in response to applying the first net pressure force against the mandrel when in the open configuration. In some embodiments, the friction reduction system comprises a biasing element configured to stroke the mandrel in a second axial direction that is opposite the first axial direction when the valve is in the closed configuration. In some embodiments, the friction reduction system comprises a stator comprising a plurality of helical stator lobes and coupled to both the housing and the second valve body such that rotation between the stator and the second valve body is restricted, and a rotor comprising a plurality of helical rotor lobes and rotatably disposed in the stator, wherein the rotor is coupled to the first valve body such that relative rotation between the rotor and the first valve body is restricted. In certain embodiments, the friction reduction system comprises a first flowpath extending through a central passage formed in the rotor, a second flowpath extending through a set of cavities formed between the stator lobes and the rotor lobes, and a nozzle positioned along the first flowpath, wherein the nozzle is configured to control an amount of fluid flowing along the second flowpath relative to an amount of fluid flowing along the first flowpath. In certain embodiments, the friction reduction system comprises a flow-transportable dart configured to land within the central passage of the rotor to increase the amount of fluid flowing along the second flowpath relative to the amount of fluid flowing along the first flowpath. In some embodiments, a central passage and a bypass passage offset from the central passage are each formed in the first valve body. In some embodiments, fluid communication is permitted between the bypass passage of the first valve body and the bypass passage of the second valve body when the valve is in the open configuration, and fluid communication is restricted between the bypass passage of the first valve body and the bypass passage of the second valve body when the valve is in the closed configuration. In certain embodiments, a first flowpath is formed when the valve is in both the open configuration and the closed configuration and which extends through a radial port of the first valve body and into a central passage of the mandrel, and a second flowpath is formed when the valve is in the open configuration but not in the closed configuration and which extends through both a bypass passage of the first valve body and a bypass passage of the second valve body. In certain embodiments, the friction reduction system comprises a diffuser coupled to the housing such that a flowpath is provided between the central passage of the housing and an environment surrounding the housing, wherein the diffuser has a fluid inlet and a plurality of fluid outlets greater in number than the fluid inlet. In some embodiments, a scallop is formed in an outer surface of the housing and is configured with both a bottom and a continuous sidewall surrounding the bottom, and the friction reduction system further comprises a diffuser coupled to the housing and at least partially received in the scallop, wherein the diffuser provides a flowpath between the central passage of the housing and an environment surrounding the housing. In some embodiments, the friction reduction system comprises a diffuser coupled to the housing such that a flowpath is provided between the central passage of the housing and an environment surrounding the housing, wherein the flowpath extends in a first, radially outwards direction through a fluid inlet of the diffuser and in a second direction through a fluid outlet of the diffuser that is at an angle of greater than thirty degrees from the first direction.

A friction reduction system deployable in a wellbore comprises a housing comprising a central axis and a central passage, a valve disposed in the housing and comprising a first valve body defining a bypass passage and a second valve body defining both a radial port and a bypass passage, wherein the first valve body is permitted to rotate relative to the second valve body, and a mandrel coupled to the second valve body and permitted to travel axially relative to the housing, wherein a first flowpath is formed in the friction reduction system when the valve is in both an open configuration and a closed configuration, the first flowpath extending through the radial port of the first valve body and into a central passage of the mandrel, wherein a second flowpath is formed in the friction reduction system when the valve is in the open configuration but not in the closed configuration, the second flowpath extending through both the bypass passage of the first valve body and the bypass passage of the second valve body. In some embodiments, the friction reduction system comprises a stator comprising a plurality of helical stator lobes and coupled to both the housing and the second valve body such that rotation between the stator and the second valve body is restricted, and a rotor comprising a plurality of helical rotor lobes and rotatably disposed in the stator, wherein the rotor is coupled to the first valve body such that relative rotation between the rotor and the first valve body is restricted. In some embodiments, the rotor defines a central passage extending therethrough, and wherein a third flowpath extends through the central passage of the rotor, the stator lobes and the rotor lobes define a set of cavities located between the stator lobes and the rotor lobes, and wherein a fourth flowpath extending through the set of cavities, and the friction reduction system further comprises a nozzle positioned along the third flowpath, wherein the nozzle is configured to control an amount of fluid flowing along the fourth flowpath relative to an amount of fluid flowing along the third flowpath. In certain embodiments, the friction reduction system comprises a flow-transportable dart configured to land within the central passage of the rotor to increase the amount of fluid flowing along the second flowpath relative to the amount of fluid flowing along the first flowpath. In certain embodiments, the housing comprises a nozzle configured to meter an amount of drilling fluid ejected from the friction reduction system when the valve is in the open configuration. In some embodiments, the friction reduction system comprises a biasing member configured to apply a biasing force against the mandrel, wherein the mandrel is stroked in a first axial direction in response to applying a net pressure force against the mandrel when the valve transitions from the closed configuration to the open configuration, and wherein the biasing member is configured to stroke the mandrel in a second axial direction that is opposite the first axial direction when the valve is in the closed configuration. In some embodiments, the valve is configured to apply a first net pressure force against the mandrel that corresponds to a drilling fluid pressure when in the open configuration, and the valve is configured to apply a second net pressure force against the mandrel that corresponds to a wellbore fluid pressure when in the closed configuration. In certain embodiments, the friction reduction system comprises a diffuser coupled to the housing such that a discharge flowpath is provided between the central passage of the housing and an environment surrounding the housing, wherein the diffuser has a fluid inlet and a plurality of fluid outlets greater in number than the fluid inlet. In certain embodiments, a scallop is formed in an outer surface of the housing and is configured with both a bottom and a continuous sidewall surrounding the bottom, and the friction reduction system further comprises a diffuser coupled to the housing and at least partially received in the scallop, wherein the diffuser provides a discharge flowpath between the central passage of the housing and an environment surrounding the housing. In some embodiments, the friction reduction system comprises a diffuser coupled to the housing such that a discharge flowpath is provided between the central passage of the housing and an environment surrounding the housing, wherein the discharge flowpath extends in a first, radially outwards direction through a fluid inlet of the diffuser and in a second direction through a fluid outlet of the diffuser that is at an angle of greater than thirty degrees from the first direction.

An embodiment of a friction reduction system deployable in a wellbore comprises a housing comprising a central axis and defining a central passage extending through the housing, a valve disposed in the housing and comprising a first valve body and a second valve body, wherein the first valve body is permitted to rotate relative to the second valve body, a mandrel coupled to the second valve body and permitted to travel axially relative to the housing, and a biasing member configured to apply a biasing force against the mandrel, wherein the mandrel is stroked in a first axial direction in response to applying a net pressure force against the mandrel when the valve is transitioned from a closed configuration to an open configuration, wherein the valve comprises a closed configuration, and wherein the biasing member is configured to stroke the mandrel in a second axial direction that is opposite the first axial direction when the valve is transitioned from the open configuration to the closed configuration. In some embodiments, the friction reduction system comprises a stator comprising a plurality of helical stator lobes and coupled to both the housing and the second valve body such that rotation between the stator and the second valve body is restricted, and a rotor comprising a plurality of helical rotor lobes and rotatably disposed in the stator, wherein the rotor is coupled to the first valve body such that relative rotation between the rotor and the first valve body is restricted. In some embodiments, the friction reduction system comprises a third flowpath extending through a central passage formed in the rotor, a fourth flowpath extending through a set of cavities formed between the stator lobes and the rotor lobes, and a nozzle positioned along the third flowpath, wherein the nozzle is configured to control an amount of fluid flowing along the fourth flowpath relative to an amount of fluid flowing along the third flowpath. In some embodiments, the housing comprises a nozzle configured to meter an amount of drilling fluid ejected from the friction reduction system when the valve is in the open configuration. In certain embodiments, a first flowpath is formed when the valve is in both the open configuration and the closed configuration and which extends through a radial port of the first valve body and into a central passage of the mandrel, and a second flowpath is formed when the valve is in the open configuration but not when the valve is in the closed configuration and which extends through both a bypass passage of the first valve body and a bypass passage of the second valve body. In certain embodiments, the valve is configured to apply a first net pressure force against the mandrel that corresponds to a drilling fluid pressure when in the open configuration, and the valve is configured to apply a second net pressure force against the mandrel that corresponds to a wellbore fluid pressure when in the closed configuration. In certain embodiments, the friction reduction system comprises a diffuser coupled to the housing such that a flowpath is provided between the central passage of the housing and an environment surrounding the housing, the diffuser has a fluid inlet and a plurality of fluid outlets greater in number than the fluid inlet. In some embodiments, a scallop is formed in an outer surface of the housing, where the scallop is configured with a bottom and a continuous sidewall surrounding the bottom, and the friction reduction system further comprises a diffuser coupled to the housing and at least partially received in the scallop, wherein the diffuser provides a flowpath between the central passage of the housing and an environment surrounding the housing. In some embodiments, the friction reduction system comprises a diffuser coupled to the housing such that a flowpath is provided between the central passage of the housing and an environment surrounding the housing, wherein the flowpath extends in a first, radially outwards direction through a fluid inlet of the diffuser and in a second direction through a fluid outlet of the diffuser that is at an angle of greater than thirty degrees from the first direction.

BRIEF DESCRIPTION OF THE DRAWINGS

For a detailed description of disclosed embodiments, reference will now be made to the accompanying drawings in which.

DETAILED DESCRIPTION OF DISCLOSED EMBODIMENTS

Figure 1:
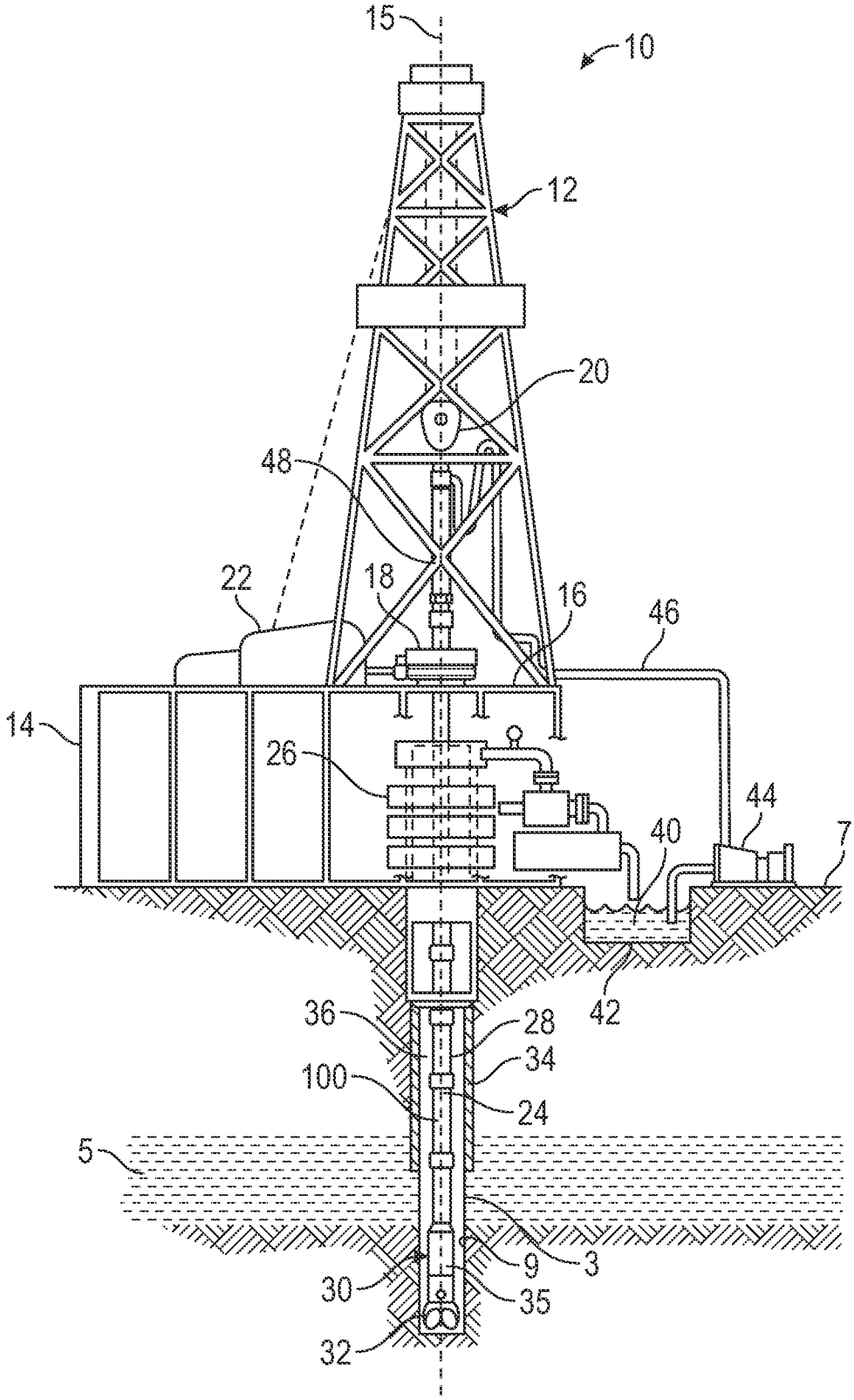
FIG. 1 is a schematic view of a drilling system including a friction reduction system according to some embodiments.
Figure 2:
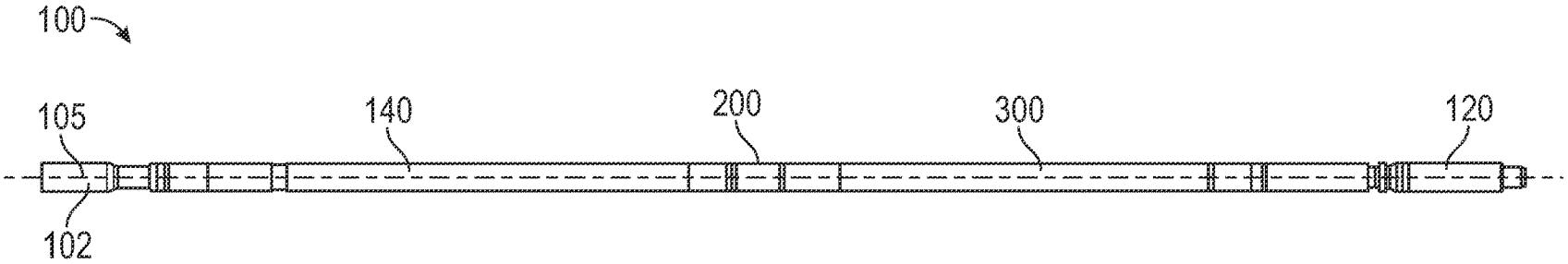
FIG. 2 is a side view of the friction reduction system of FIG. 1.
Figure 3A:
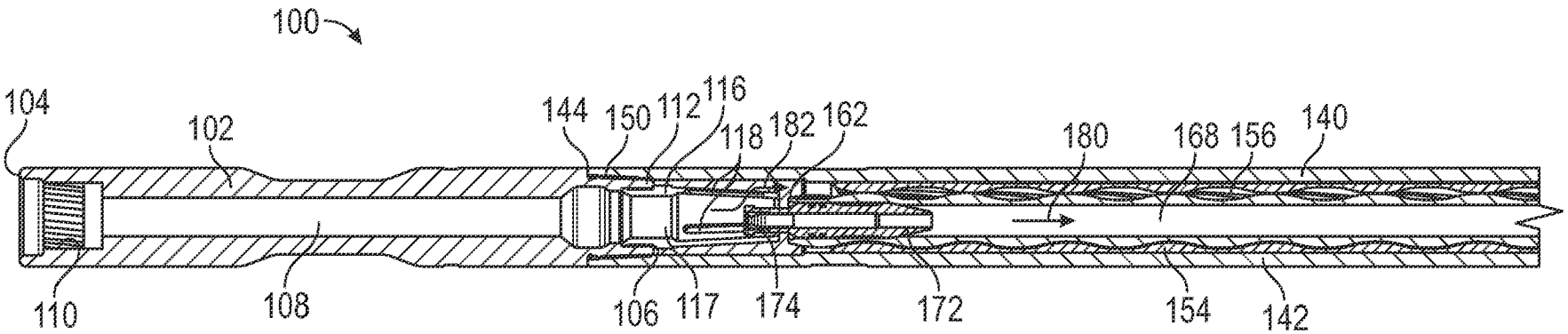
FIG. 3A is a side cross-sectional view of an uphole section of the friction reduction system of FIG. 1.
Figure 3B:
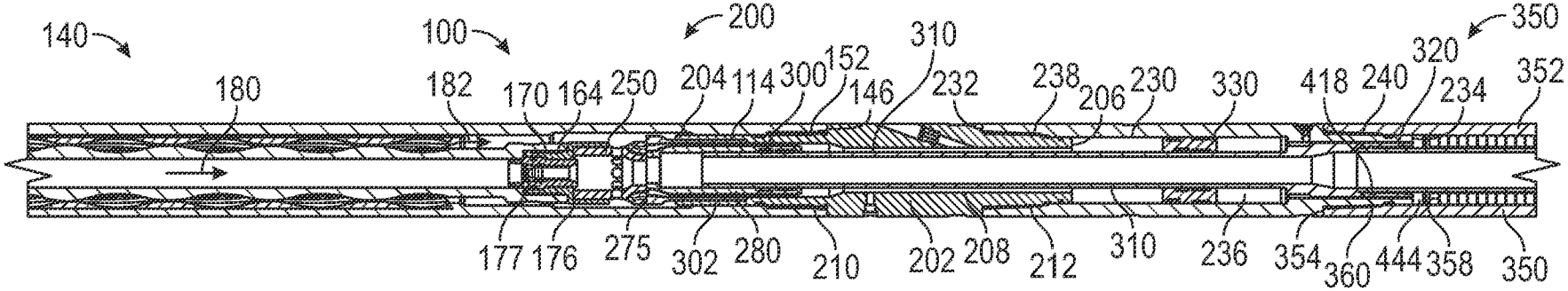
FIG. 3B is a side cross-sectional view of an intermediate section of the friction reduction system of FIG. 1.
Figure 3C:
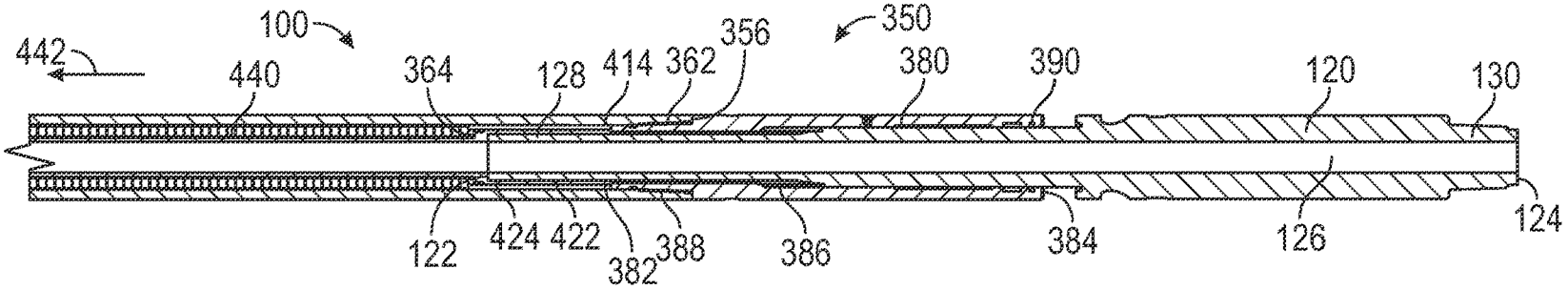
FIG. 3C is a side cross-sectional view of a downhole section of the friction reduction system of FIG. 1.

The following discussion is directed to various embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection as accomplished via other devices, components, and connections. In addition, as used herein, the terms "axial" and "axially" generally mean along or parallel to a central axis (for example, central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the wellbore and with "down", "lower", "downwardly", "downhole", or "downstream" meaning toward the terminal end of the wellbore, regardless of the wellbore orientation.

As described previously, friction reduction tools may at times be utilized to reduce friction between a drillstring and a sidewall of a wellbore. Particularly, the friction reduction tool may induce oscillatory motion in the drillstring in an effort to break static friction and prevent the drillstring from sticking to the sidewall of the wellbore. Conventional friction reduction tools may comprise an agitator and an oscillator or shock tool positioned upstream of the agitator (for example, between the agitator and an upper end of the drillstring at the surface). The agitator may include a valve which periodically and abruptly obstructs or chokes the flow of drilling fluid through the agitator, thereby creating a pressure pulse within the drilling fluid which travels upstream to the shock tool. The shock tool may include a spring-loaded mandrel which may extend in response to the application of the pressure pulse against the mandrel and which may also retract in response to a biasing force applied against the mandrel by a biasing member of the shock tool after the pressure pulse has dissipated. Accordingly, the shock tool may periodically axially extend and retract in response to the periodic application of pressure pulses within the drilling fluid induced by the agitator positioned downstream from the shock tool. The axial oscillatory motion induced in the shock tool may be communicated to the drillstring coupled to the shock tool to inhibit the drillstring from sticking to the sidewall of the wellbore.

While the axial oscillating motion generated by the shock tool may reduce friction between the drillstring and the sidewall of the wellbore, the periodic choking of the flow of drilling fluid by the agitator of the conventional friction reduction tool may result in a substantial drop in pressure of the drilling fluid across the agitator. The amount of pressure which may be imparted to the drilling fluid at the surface by a surface pump may be limited by surface equipment (for example, by a surface mud pump, a blowout preventer (BOP)), and thus downhole pressure losses, such as the pressure drop across the agitator of the conventional friction reduction tool, may hinder the effectiveness of other downhole equipment operated by the drilling fluid, such as a downhole mud motor connected to the drillstring and powered by the drilling fluid.

Accordingly, embodiments disclosed herein include downhole friction reduction systems configured to reduce friction between a drillstring and a sidewall of a wellbore without periodically choking the flow of drilling fluid and thereby inducing a substantial pressure drop in the drilling fluid. Particularly, friction reduction systems described herein are configured to generate a cyclical pressure fluctuation therein in response to cyclically applying pressure from a drilling fluid flowing therein to a reciprocal mandrel of the friction reduction system. Particularly, a minimal, controlled amount of the drilling fluid is diverted along a flowpath extending through a valve of the friction reduction system whereby the drilling fluid pressure is applied to the mandrel which otherwise is exposed to wellbore fluid having a pressure that is substantially less than the drilling fluid. The amount of drilling fluid diverted may be minimized by minimizing a total flow area (TFA) of the flowpath along which the diverted drilling fluid flows. In this manner, the pressure differential between the drilling fluid and the wellbore fluid, which may be substantially greater than the pressure differential which may be generated from choking the flow of drilling fluid, may be leveraged to induce axial oscillatory motion in the drillstring. In some embodiments, a small amount of drilling fluid may be ejected to the wellbore to reduce a flowrate of the drilling fluid downstream of the friction reduction system and thereby reduce the pressure drop of the drilling fluid seen by downstream components, such as a BHA connected to the drillstring.

In embodiments of friction reduction systems disclosed herein, some of the diverted fluid may be discharged from the friction reduction system to the wellbore surrounding the friction reduction system. Given that the fluid discharged from the friction reduction system may be at an elevated drilling pressure, embodiments of friction reduction systems may include a diffuser to decelerate or reduce a velocity of the fluid discharged from the friction reduction system. A sidewall of the wellbore may be protected by reducing the velocity of the fluid discharged by the friction reduction system. As described previously, a mud cake is formed along the sidewall of the wellbore during the drilling process, where the mud cake provides a physical barrier which mitigates the transmission of fluid between the wellbore and the earthen formation surrounding the wellbore. For example, the mud cake minimizes the amount of drilling fluid circulating through the wellbore that is lost to the earthen formation, where losses of drilling fluid to the earthen formation may reduce the safety margin provided by the drilling mud, requiring an additional amount of drilling fluid to make-up for the drilling fluid lost to the earthen formation. By protecting the mud cake through reducing the velocity of fluid discharged by the friction reduction system, the amount of fluid lost to the earthen formation may be minimized during the process.

Referring to FIG. 1, an embodiment of a well or drilling system 10 for drilling or producing hydrocarbons from a well or wellbore is shown. In this exemplary embodiment, drilling system 10 generally includes a vertical support structure or derrick 12 supported by a drilling platform 14. Platform 14 includes a drill deck or rig floor 16 supporting a rotary table 18 selectively rotated by a prime mover (not shown), such as an electric motor, controlled by a motor controller. Derrick 12 includes a traveling block 20 controlled by a drawworks 22 for raising and lowering a drillstring 24 suspended from traveling block 20. Drillstring 24 of drilling system 10 extends downward through the rotary table 18, a blowout preventer (BOP) stack 26, and into a wellbore 3 that extends into a subterranean earthen formation 5 along a central or longitudinal axis 15 from the surface 7. Drillstring 24 is formed from a plurality of drill pipe joints 28 connected end-to-end. In this exemplary embodiment, a bottom-hole-assembly (BHA) 30 is attached to the lowermost pipe joint 28 and a drill bit 32 is attached to the downhole end of BHA 30. In other embodiments, drilling system 10 may comprise an offshore drilling system that includes a drillstring that extends through a marine riser and into a subsea wellbore.

In this embodiment, drill bit 32 is rotated with rotary table 18 via drillstring 24 and BHA 30. By rotating drill bit 32 with weight-on-bit (WOB) applied thereto, the drill bit 32 disintegrates the subsurface formations to drill wellbore 3. In some embodiments, a top-drive may be used to rotate the drillstring 24 rather than rotation by the rotary table 18. In some applications, a downhole motor (mud motor) 35 is disposed in the drillstring 24 to rotate the drill bit 32 in lieu of or in addition to rotating the drillstring 24 from the surface 7. Particularly, the mud motor 35 may rotate the drill bit 32 when a drilling fluid passes through the mud motor 35 under pressure. In this exemplary embodiment, a casing string 34 is installed and extends downward generally from the surface 7 into at least a portion of wellbore 3. In some embodiments, casing string 34 is cemented within the wellbore 3 to isolate various vertically-separated earthen zones and prevent fluid transfer between the zones. BOP stack 26 is secured to the uphole end of casing string 34. Casing string 34 may comprise multiple tubular members, such as pieces of threaded pipe that are joined end-to end to form liquid-tight or gas-tight connections, to prevent fluid and pressure exchange between wellbore 3 and the surrounding earthen zone.

An annular space or annulus 36 is formed between both the sidewall 9 of wellbore 3 and drillstring 24 and between inner surface of casing string 34 and drillstring 24. In other words, annulus 36 extends through wellbore 3 and casing string 34. BOP stack 26 includes an annular space or flow path in fluid communication with annulus 36. An operator or drilling control system of drilling system 10 may selectively and controllably open and close one or more BOPs of BOP stack 26 to allow, to restrict, or to inhibit the flow of drilling fluid or another fluid through annulus 36. In this exemplary embodiment, drilling system 10 includes a drilling fluid circulation system to circulate drilling fluid or mud 40 down drillstring 24 and back up annulus 36. Drilling fluid 40 generally functions to cool drill bit 32, remove cuttings from the bottom of wellbore 3, and maintain a desired pressure or pressure profile in wellbore 3 during drilling operations. Drilling system further includes a drilling fluid reservoir or mud tank 42, a supply pump 44, a supply line 46 connected to the outlet of supply pump 44, and a kelly 48 for supplying drilling fluid 40 to the drillstring 24.

In this exemplary embodiment, along with drill pipe joints 28, drillstring 24 includes a friction reduction system 100 configured to reduce friction between drillstring 24 and the sidewall 9 of wellbore 3 while preventing or at least minimizing damage to a sidewall or mud cake of the wellbore 3. Although only a single friction reduction system 100 is shown in FIG. 1, in other embodiments, drilling system 10 may include a plurality of friction reduction systems 100 spaced along the drillstring 24. Drilling system 10 may be operated whereby drilling fluid 40 is pumped through drillstring 24 and to the mud motor 35 to rotate the drill bit 32. As mud motor 35 is operated to rotate drill bit 32, drillstring 24 may not be rotated at the surface by rotary table 18 and instead may axially slide through wellbore 3. Drilling fluid may be pumped at a drilling fluid pressure through friction reduction system 100 to induce axial oscillatory motion in drillstring 24 and thereby break static friction between drillstring 24 and the sidewall 9 of wellbore 3. Friction reduction system 100 may not choke the flow of drilling fluid 40 therethrough and thus the pressure drop across friction reduction system 100 may be minimized or eliminated. Minimizing the pressure drop across friction reduction system 100 may provide additional pressure to mud motor 35, which may enhance the performance of mud motor 35 (for example, increasing the torque or power outputted by mud motor 35).

Referring now to FIGS. 2 and 3A-3C, an embodiment of the friction reduction system 100 is shown. In this exemplary embodiment, friction reduction system 100 has a central or longitudinal axis 105 and generally includes a first or top sub 102, a second or bottom sub 120 that is opposite top sub 102, a power sub or section 140, a valve sub or section 200, and a shock sub or section 350. Top and bottom subs 102, 120 may each couple friction reduction system 100 to the drillstring 24. Top sub 102 includes a first or uphole end 104, a second or downhole end 106 that is opposite uphole end 104, and a central bore or passage 108 extending between ends 104, 106. Top sub 102 also includes an internal uphole connector 110 at the uphole end 104 thereof and formed on an inner surface of top sub 102. Uphole connector 110 may releasably or threadably connect to a drill pipe joint 28 of the drillstring 24 of drilling system 10. Top sub 102 further includes an external downhole connector 112 at the downhole end 106 thereof and formed on an outer surface of top sub 102. Downhole connector 112 may releasably or threadably connect to an uphole end of the power sub 140 of friction reduction system 100.

In this exemplary embodiment, a dart guide 116 is connected to top sub 102 and projects outwardly from the downhole end 106 of top sub 102. Dart guide 116 may releasably or threadably connect to a downhole internal connector of top sub 102 formed on the inner surface thereof. Dart guide 116 includes a central bore or passage 117 and plurality of circumferentially spaced radial openings or ports 118. Central passage 117 gradually reduces in diameter moving from a first or uphole end of dart guide 116 connected to the downhole end 106 of top sub 102 to a second or downhole end that is opposite the uphole end of dart guide 116. As will be discussed further herein, dart guide 116 is configured to guide a flow-transported obturating member or dart into the power sub 140 of friction reduction system 100. Additionally, dart guide 116 may assist in routing a flow of drilling fluid through power sub 140 of friction reduction system 100. Further, dart guide 116 may act as a rotor catch to prevent rotor 160 from backing up from and disengaging with stator 142. In other embodiments, system 100 may not include dart guide 116.

Bottom sub 120 includes a first or uphole end 122, a second or downhole end 124 that is opposite uphole end 122, and a central bore or passage 126 extending between ends 122, 124. Bottom sub 120 also includes an external uphole connector 128 at the uphole end 122 thereof and formed on an outer surface of bottom sub 120. Uphole connector 128 may releasably or threadably connect to the shock sub 350 of friction reduction system 100 as will be discussed further herein. Bottom sub 120 further includes an external downhole connector 130 at the downhole end 124 thereof and formed on an outer surface of bottom sub 120. Downhole connector 130 may releasably or threadably connect to a drill pipe joint 28 of the drillstring 24 of drilling system 10. As will be discussed further herein, bottom sub 120 may travel axially (along central axis 105) relative to top sub 102 whereby a maximum axial length of friction reduction system 100 may fluctuate periodically to induce motion in the drillstring 24 of drilling system 10.

Figure 4:
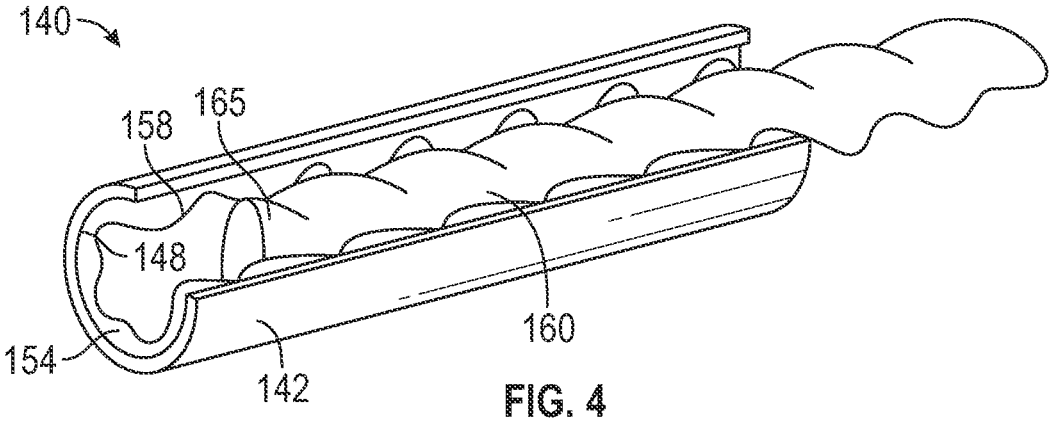
FIG. 4 is a perspective, partial cross-sectional view of a power sub of the friction reduction system of FIG. 1 according to some embodiments.
Figure 5:
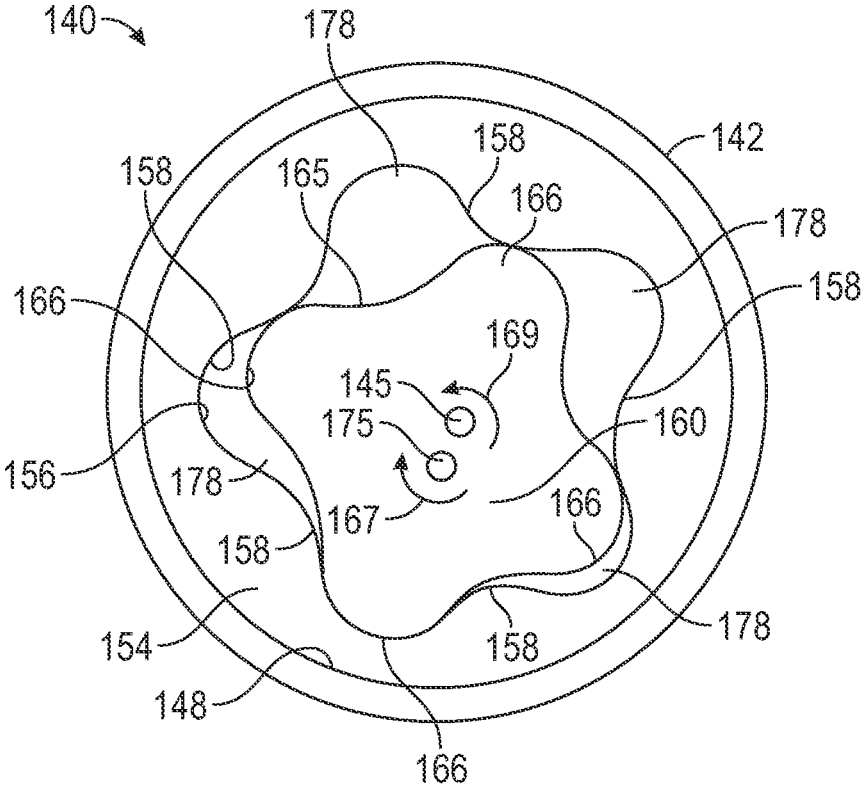
FIG. 5 is an end cross-sectional view of the friction reduction system of FIG. 1.
Figure 6:
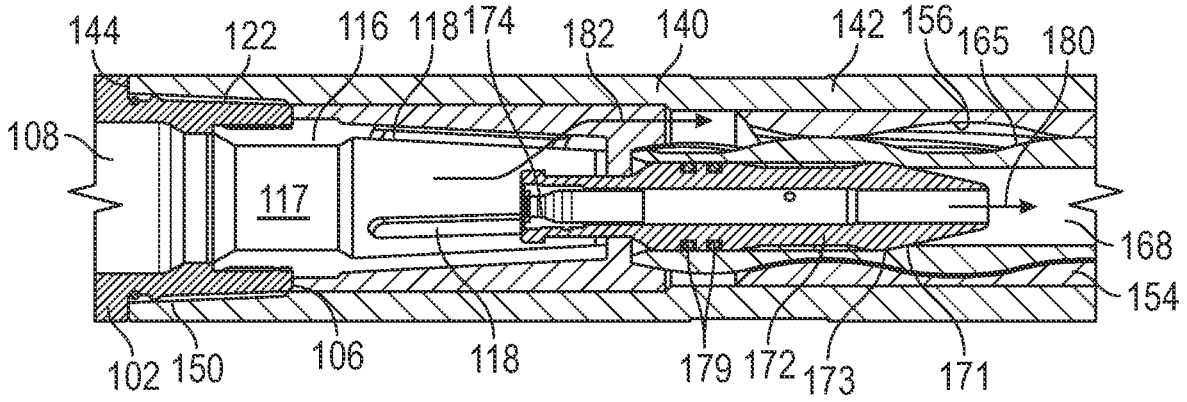
FIG. 6 is a side cross-sectional view of the friction reduction system of FIG. 1.

Referring to FIGS. 2-7, additional views of the power sub 140 are provided in FIGS. 4-6. Power sub 140 of friction reduction system 100 is generally configured to circulate drilling fluid in response to the pumping of drilling fluid 40 at the surface by supply pump 44 along a plurality of distinct flowpaths. In this exemplary embodiment, power sub 140 generally includes a housing or stator 142 and a rotor 160 rotatably disposed in the stator 142. Stator 142 includes a central or longitudinal axis 145, a first or uphole end 144, a second or downhole end 146, and a central passage defined by a generally cylindrical inner surface 148 extending between ends 144, 146. The inner surface 148 of stator 142 includes an internal first or uphole connector 150 positioned at uphole end 144 and which forms a first or uphole box end of stator 142. Uphole connector 150 is configured to threadably couple with the downhole connector 112 of top sub 102 to couple stator 142 with top sub 102. Additionally, an annular seal assembly may be positioned at the interface formed between the uphole end 144 of stator 142 and the downhole end 106 of top sub 102 to seal the connection formed therebetween.

The inner surface 148 of stator 142 additionally includes an internal second or downhole connector 152 positioned at downhole end 146 thereof, forming a second or downhole box end of stator 142. Downhole connector 152 may couple stator 142 with the valve sub 200 as described further herein. In this exemplary embodiment, a helical-shaped elastomeric liner or insert 154 is formed on the inner surface 148 of stator 142. A helical-shaped inner surface 156 of elastomeric insert 154 defines a plurality of stator lobes 158. In other embodiments, stator 142 may not include an insert and instead may comprise a single monolithically formed body.

In this exemplary embodiment, rotor 160 includes a longitudinal or central axis 175, a first or uphole end 162, a second or downhole end 164 that is opposite uphole end 162, and a helical-shaped outer surface 165 extending between ends 162, 164 and which defines a plurality of rotor lobes 166 which intermesh with the stator lobes 158 of stator 142. Rotor 160 additionally includes a central bore or passage 168 extending entirely through the rotor 160 between ends 162, 164, and a downhole receptacle 170 extending into rotor 160 from the downhole end 164 thereof. The downhole receptacle 170 of rotor 160 receives a valve adapter 176 and a rotor nozzle 177 sealingly received in the central passage 168 of rotor 160.

In this exemplary embodiment, friction reduction system 100 may include a flow-transported obturating member or dart 172 (shown in FIG. 6). Specifically, friction reduction system 100, including subs 102, 120, power sub 140, valve sub 200, and shock sub 350, may initially be run into wellbore 3 along drillstring 24 without dart 172. Friction reduction system 100 may then be operated within wellbore 3 to induce an oscillation in at least a portion of the drillstring 24. At some point during the operation of friction reduction system 100, it may become desirable to adjust the frequency of the oscillation induced in drillstring 24 by friction reduction system 100. Dart 172 may be flow-transported or pumped from the surface 7 through the drillstring 24 and landed within power sub 140 whereby friction reduction system 100 may induce an oscillation in drillstring 24 at a second frequency that is different from the first frequency. Dart 172 may comprise an optional component which may not be pumped into power sub 140 during each use of friction reduction system 100.

In this exemplary embodiment, dart 172 includes an external landing profile 173 and a dart nozzle 174 positioned within a central passage of the dart 172. External landing profile 173 of dart 172 is configured to land against an internal landing profile 171 formed on a cylindrical inner surface of the rotor 160 which defines the central passage 168 thereof. Dart 172 may additionally include a pair of annular seal assemblies 179 formed on an outer surface thereof and configured to sealingly engage the inner surface of rotor 160 upon landing therein. Seal assemblies 179 may restrict a flow of fluid across an annular interface formed between the inner surface of rotor 160 and the outer surface of dart 172. Additionally, as dart 172 is pumped dart 172 is guided into the central passage 168 of rotor 160 by rotor guide 116. Particularly, the gradual reduction in diameter of the central passage 117 of dart guide 116 centralizes dart 172 within power sub 140 to sufficiently align a central axis of dart 172 and the central axis 175 of rotor 160 to permit dart 172 to enter central passage 168 of rotor 160.

As best shown in FIG. 5, in this exemplary embodiment, rotor 160 has one fewer lobe 166 than the stator 142. In this configuration, when rotor 160 and stator 142 are assembled, a series of cavities 178 are formed between the outer surface 165 of rotor 160 and the inner surface 156 of the elastomeric insert 154 of stator 142. Each cavity 178 is sealed from adjacent cavities 178 by seals formed along the contact lines between stator 142 and rotor 160. Additionally, the central axis 175 of rotor 160 is radially offset from the central axis 145 of stator 142 by a fixed value known as the "eccentricity" of the rotor-stator assembly. Consequently, rotor 160 may be described as rotating eccentrically within stator 142.

In this exemplary embodiment, the assembly of stator 142 and rotor 160 forms a progressive cavity device, and particularly, a progressive cavity motor configured to transfer fluid pressure applied to the rotor-stator assembly into rotational torque applied to rotor 160. Specifically, during operation of friction reduction system 100, drilling fluid 40 is pumped under pressure into an upstream end of the friction reduction system 100. A first portion of the drilling fluid 40 entering friction reduction system 100 flows along a first or first flowpath 180 extending through central passage 168 of rotor 160, and into and through rotor nozzle 177. A second portion of the drilling fluid 40 entering friction reduction system 100 instead flows around central passage 168 of rotor 160 along a second flowpath 182 and into a first set of open cavities 178. A pressure differential across the adjacent cavities 178 forces rotor 160 to rotate relative to the stator 142. As rotor 160 rotates inside stator 142, adjacent cavities 178 are opened and filled with drilling fluid 40 flowing along second flowpath 182.

As this rotation and filling process repeats in a continuous manner, the drilling fluid 40 flowing along second flowpath 182 flows progressively down the length of stator 142 and continues to drive the rotation of rotor 160. Rotor 160 rotates about the central axis 175 of rotor 160 in a first rotational direction (indicated by arrow 167 in FIG. 5). Additionally, rotor 160 rotates about the central axis 145 of stator 142 in a second rotational direction (indicated by arrow 169 in FIG. 5) which is the opposite of the first rotational direction of arrow 167. As will be described further herein, at least a portion of the drilling fluid 40 flowing along second flowpath 182 may drive axial oscillatory motion of the shock sub 350 of friction reduction system 100.

Figure 7:
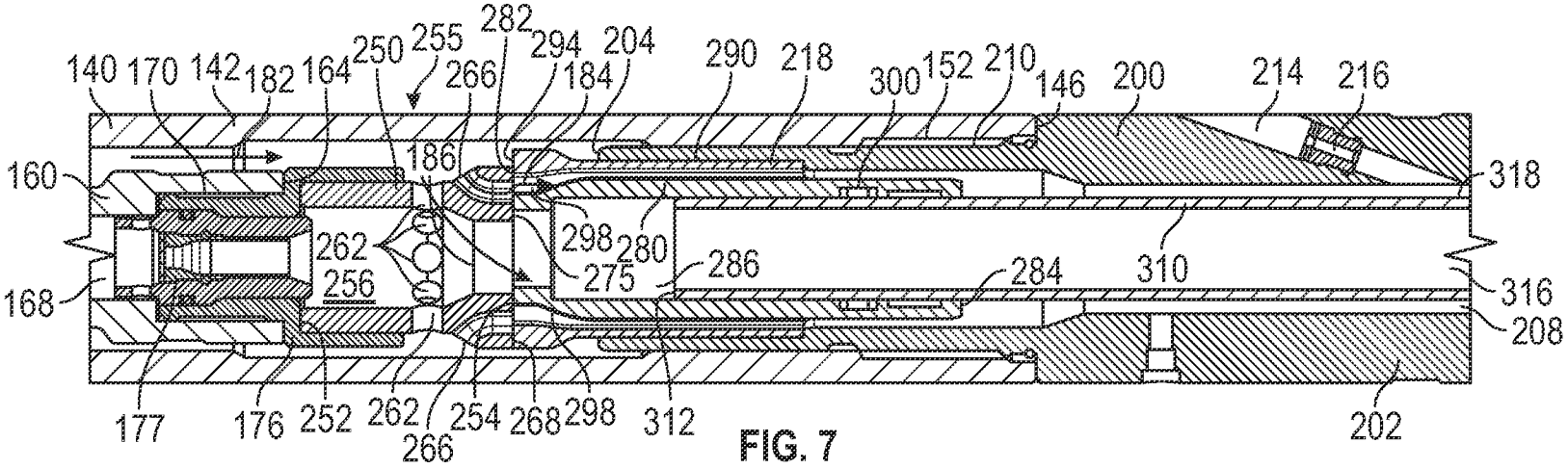
FIG. 7 is a side cross-sectional view of an uphole section of a valve sub of the friction reduction system of FIG. 1 according to some embodiments.
Figure 8:
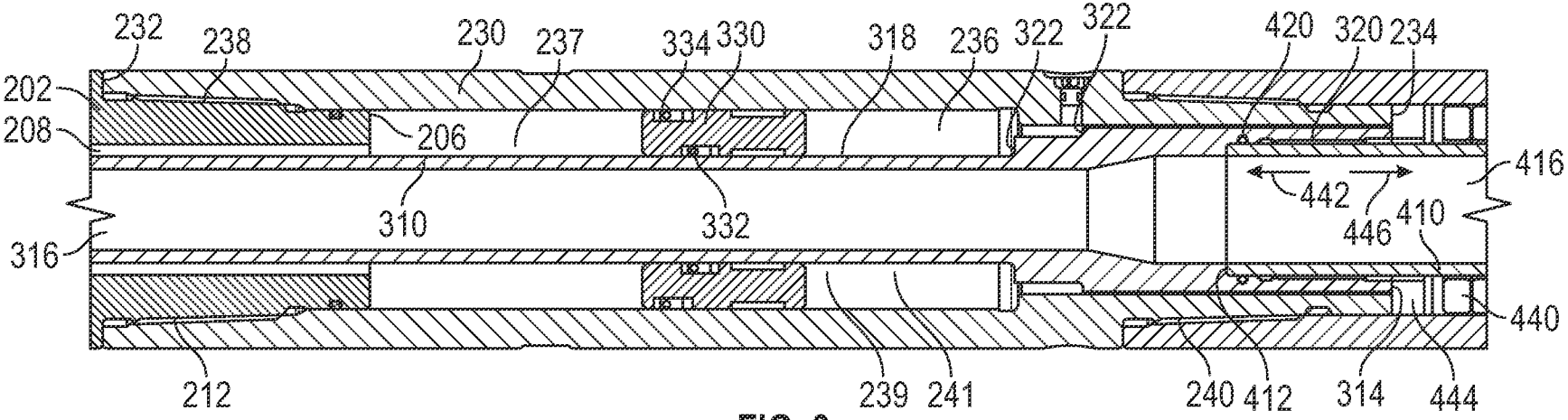
FIG. 8 is a side cross-sectional view of the friction reduction system of FIG. 1.
Figure 9:
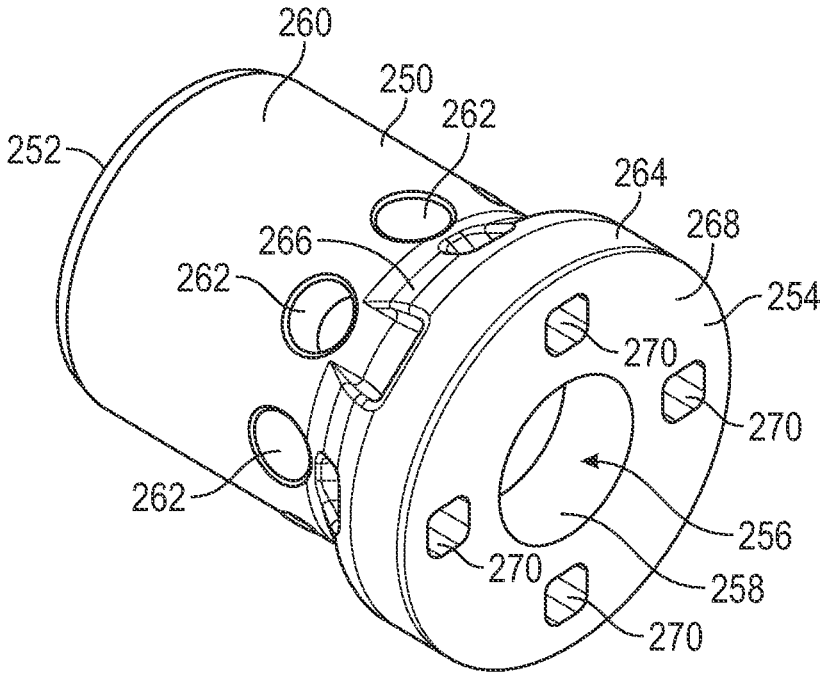
FIG. 9 is a perspective view of an embodiment of an uphole valve body of the friction reduction system of FIG. 1.
Figure 10:
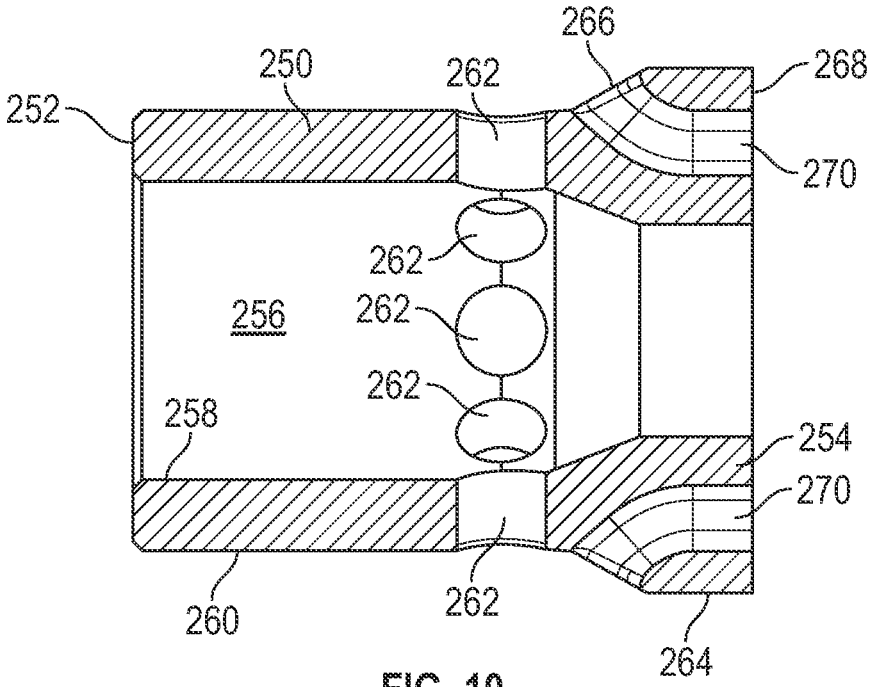
FIG. 10 is a side cross-sectional view of the uphole valve body of FIG. 9.
Figure 11:
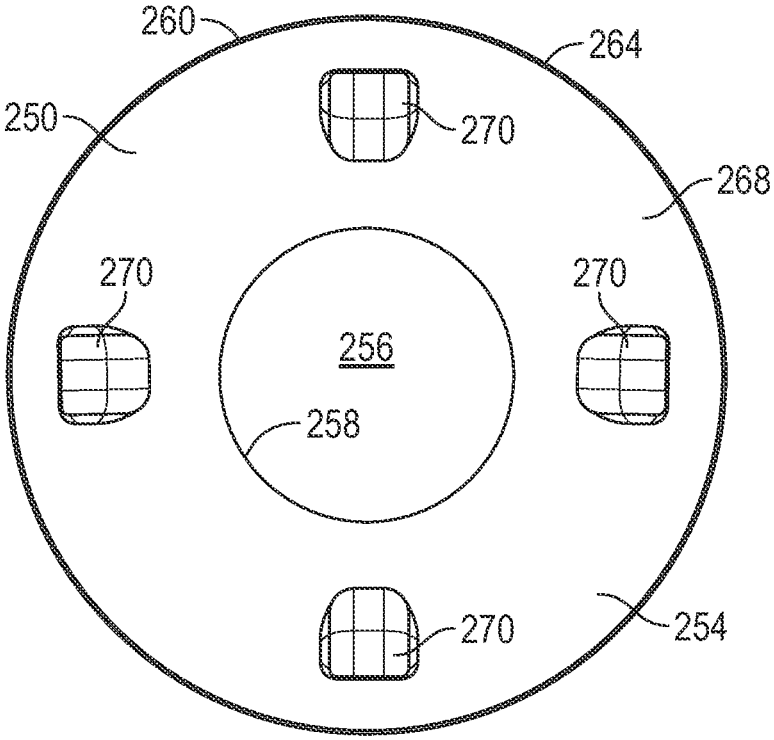
FIG. 11 is a rear view of the uphole valve body of FIG. 9.
Figure 12:
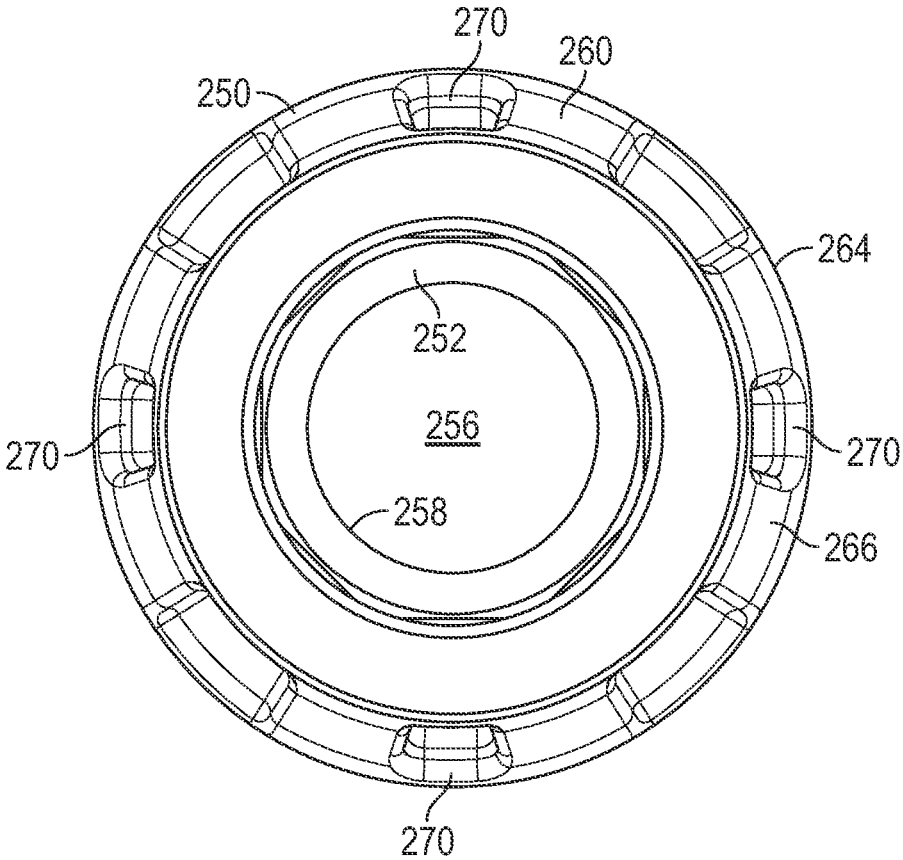
FIG. 12 is a front view of the uphole valve body of FIG. 9.
Figure 14:
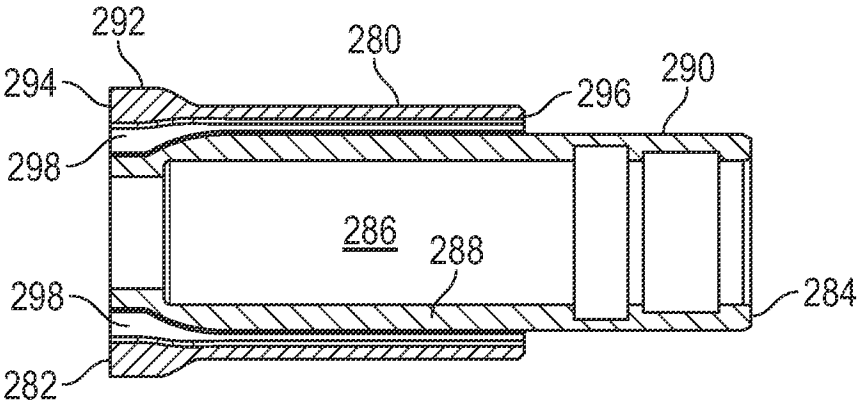
FIG. 14 is a side cross-sectional view of the downhole valve body of FIG. 13.
Figure 16:
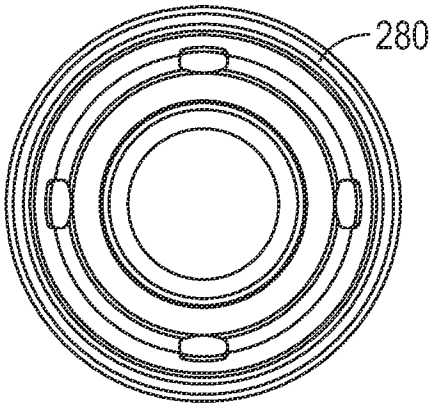
FIG. 16 is a front view of the downhole valve body of FIG. 13.
Figure 13:
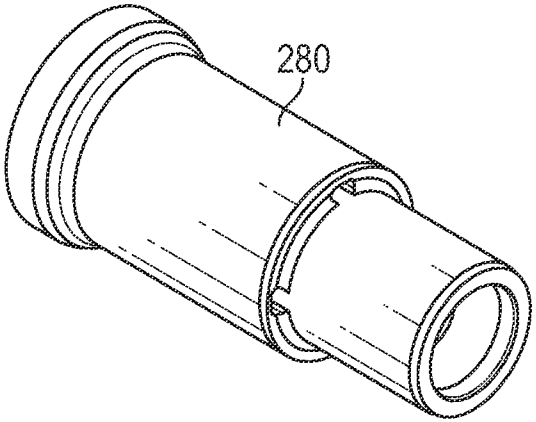
FIG. 13 is a perspective view of an embodiment of a downhole valve body of the friction reduction system of FIG. 1.
Figure 15:
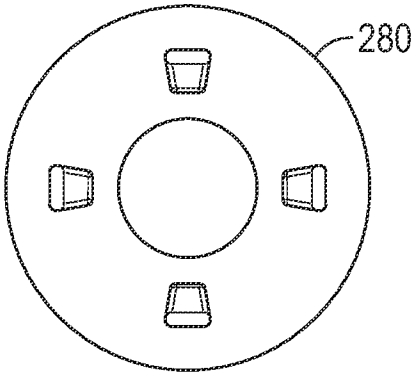
FIG. 15 is a rear view of the downhole valve body of FIG. 13.
Figure 17:
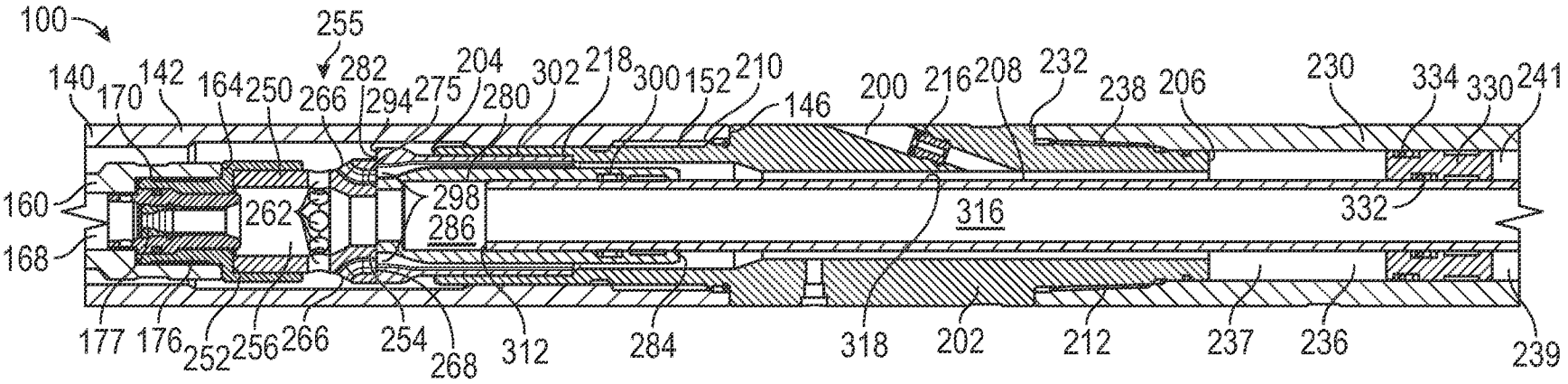
FIG. 17 is a side cross-sectional view of the friction reduction system of FIG. 1 with a rotary valve of the friction reduction system in an open configuration according to some embodiments.
Figure 18:
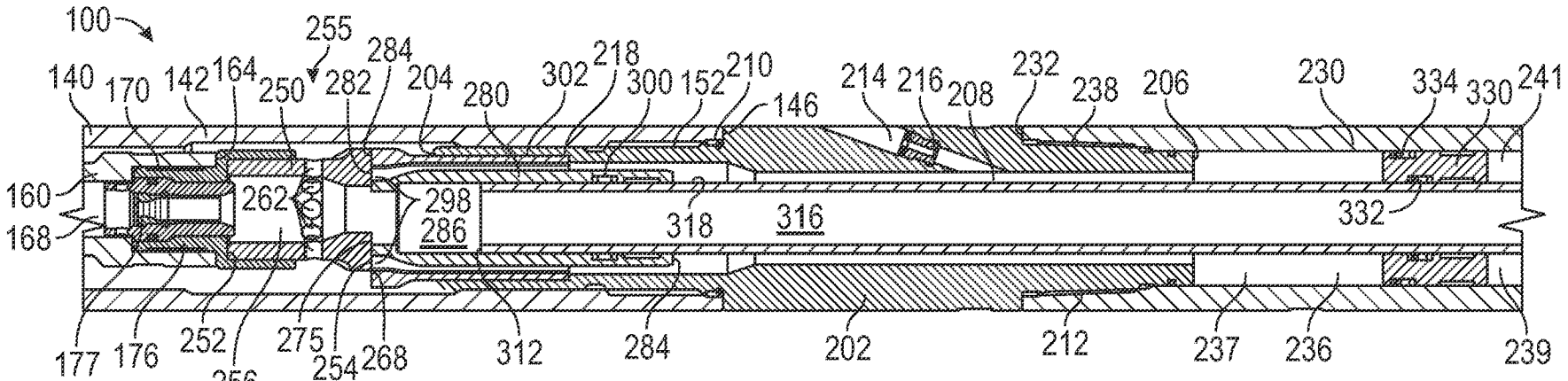
FIG. 18 is a side cross-sectional view of the friction reduction system of FIG. 1 with the valve of the friction reduction system in a closed configuration according to some embodiments.
Figure 19:
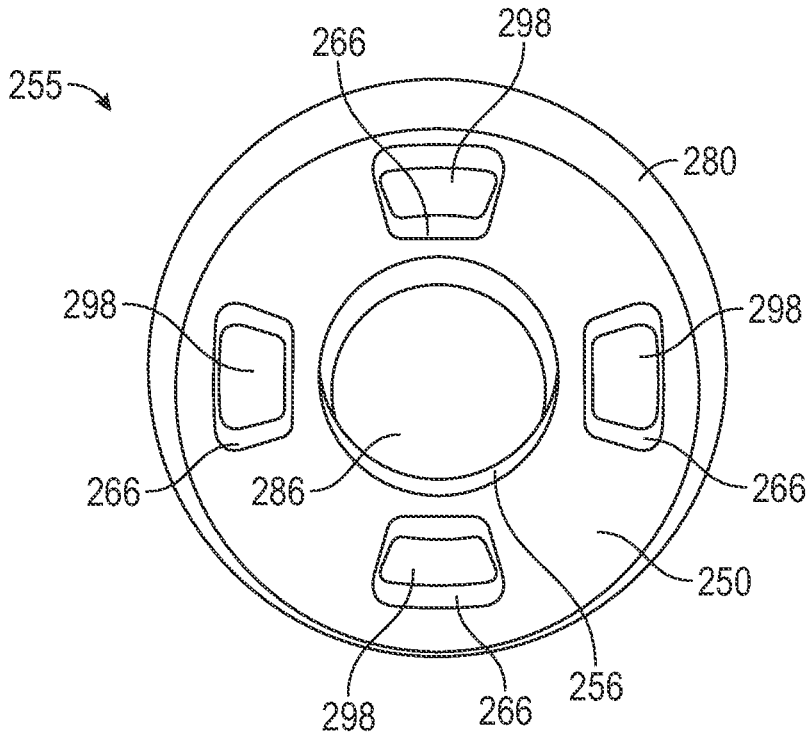
FIG. 19 is a schematic end view of the valve of FIG. 17 in the open configuration.
Figure 20:
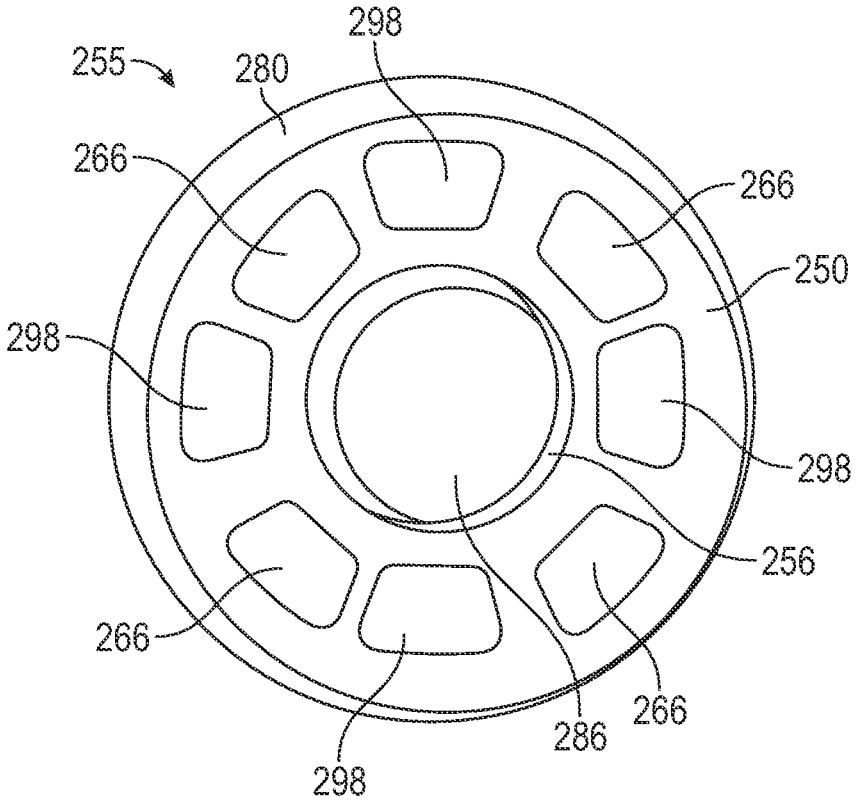
FIG. 20 is a schematic end view of the valve of FIG. 17 in the closed configuration.

Referring to FIGS. 2-3C, 7, and 8, additional views of valve sub 200 are provided in FIGS. 7, 8. Valve sub 200 of friction reduction system 100 is configured to periodically apply the pressure of at least some of the drilling fluid 40 flowing through valve sub 200 against shock sub 350 to periodically extend bottom sub 120 relative top sub 102. In this exemplary embodiment, valve sub 200 generally includes a first or uphole housing 202, a second or downhole housing 230, a first or uphole valve body 250, a second or downhole valve body 280, a mandrel or wash pipe 310, and a floating piston 330.

Uphole housing 202 includes a first or uphole end 204, a second or downhole end 206 that is opposite uphole end 204, and a central bore or passage 208 extending between ends 204, 206. Uphole housing 202 also includes an external uphole connector 210 at the uphole end 204 thereof and formed on an outer surface of uphole housing 202. Uphole connector 210 may releasably or threadably connect to the downhole connector 152 of stator 142 to couple valve sub 200 with power sub 140. An annular seal assembly may be positioned at the interface formed between the downhole end 146 of stator 142 and the uphole end 204 of uphole housing 202 to seal the connection formed therebetween. Uphole housing 202 further includes an external downhole connector 212 at the downhole end 206 thereof and formed on an outer surface of uphole housing 202. Downhole connector 212 may releasably or threadably connect to an uphole end of the downhole housing 230 of valve sub 200.

Uphole housing 202 additionally includes at least one radial port 214 providing fluid communication between the central passage 208 of uphole housing 202 and an environment surrounding friction reduction system 100 (for example, wellbore 3). In this exemplary embodiment, a nozzle or jet 216 is received within radial port 214 which is configured to provide a predefined flow restriction through radial port 214. In this manner, nozzle 216 may meter fluid flow through radial port 214 as desired based on the particular application.

Downhole housing 230 of valve sub 200 similarly includes a first or uphole end 232, a second or downhole end 234 that is opposite uphole end 232, and a central bore or passage 236 extending between ends 232, 234. Downhole housing 230 also includes an internal uphole connector 238 at the uphole end 232 thereof and formed on an inner surface of downhole housing 230. Uphole connector 238 may releasably or threadably connect to the downhole connector 212 of uphole housing 202 to couple together housings 202, 230. An annular seal assembly may be positioned at the interface formed between the downhole end 206 of uphole housing 202 and the uphole end 232 of downhole housing 230 to seal the connection formed therebetween. Downhole housing 230 further includes an external downhole connector 240 at the downhole end 234 thereof and formed on an outer surface of downhole housing 230. Downhole connector 240 may releasably or threadably connect to an uphole end of shock sub 350 to couple valve sub 200 with shock sub 350. In other embodiments, valve sub 200 may comprise a single, integrally. or monolithically formed housing from what are appreciated to be separate housings 202, 230 in some other embodiments.

Referring to FIGS. 2-3C and 9-16, additional views of valves 250, 280 are shown. Uphole valve body 250 of valve sub 200 generally includes a first or uphole end 252, a second or downhole end 254 that is opposite uphole end 252, a central bore or passage 256 defined by a generally cylindrical inner surface 258 extending between ends 252, 254, and a generally cylindrical outer surface 260 also extending between ends 252, 254. In this exemplary embodiment, uphole valve body 250 additionally includes a plurality of circumferentially spaced radial ports 262 each extending entirely between inner surface 258 and outer surface 260. Radial ports 262 are configured to maximize the flow area therethrough to minimize a pressure drop across the radial ports 262.

Additionally, the outer surface 260 of uphole valve body 250 comprises an expanded diameter or flanged section 264 positioned at the downhole end 254 of uphole valve body 250. Flanged section 264 extends between a first or uphole shoulder 266 and an annular downhole contact face 268 of uphole valve body 250 and which defines the downhole end 254 of uphole valve body 250. In this exemplary embodiment, a plurality of circumferentially spaced bypass passages 270 extend through flanged section 264 between uphole shoulder 266 and the downhole contact face 268 of uphole valve body 250.

Uphole valve body 250 is coupled to the rotor 160 of power sub 140 whereby relative rotation between uphole valve body 250 and rotor 160 is restricted such that uphole valve body 250 and rotor 160 rotate in concert relative to stator 142. In this exemplary embodiment, the uphole end 252 of uphole valve body 250 is received within valve adapter 176 which is in-turn received within the downhole receptacle 170 of rotor 160, thereby coupling uphole valve body 250 with the downhole end 164 of rotor 160. In this configuration, rotor nozzle 177 is received within the central passage 256 of uphole valve body 250. For example, valve adapter 176 may heated to expand a diameter of the central passage thereof. In this heated state, uphole valve body 250 may be inserted into valve adapter 176 and valve adapter 176 may be subsequently cooled to place the outer surface 260 of uphole valve body 250 into compression against the inner surface of valve adapter 176. In other embodiments, various mechanisms and techniques may be used to restrict relative rotation between valve adapter 176 and uphole valve body 250

Downhole valve body 280 of valve sub 200 generally includes a first or uphole end 282, a second or downhole end 284 that is opposite uphole end 282, a central bore or passage 286 defined by a generally cylindrical inner surface 288 extending between ends 282, 284, and a generally cylindrical outer surface 290 also extending between ends 282, 284. In this exemplary embodiment, the outer surface 290 of downhole valve body 280 comprises an expanded diameter or flanged section 292 extending from the uphole end 282 of downhole valve body 280. Particularly, flanged section 292 extends between an annular uphole contact face 294 of downhole valve body 280 and which defines the uphole end 282 of downhole valve body 280 and an annular shoulder 296 located between ends 282, 284. In this exemplary embodiment, a plurality of circumferentially spaced bypass passages 298 extend through flanged section 292 between uphole contact face 294 and shoulder 296 of downhole valve body 280. An annular seal assembly 300 is positioned on the inner surface 258 (shown in FIGS. 10-12) of downhole valve body 280 to sealingly engage the wash pipe 310 of valve sub 200.

Downhole valve body 280 is coupled to the stator 142 of power sub 140 through uphole housing 202 whereby relative rotation between downhole valve body 280 and stator 142 is restricted. For example, uphole housing 202 may heated to expand a diameter of the central passage 208 thereof. In this heated state, downhole valve body 280 may be inserted into central passage 208 of uphole housing 202 and uphole housing 202 may be subsequently cooled to place the outer surface 290 of downhole valve body 280 into compression against a receptacle 218 of uphole housing 202. In other embodiments, various mechanisms and techniques may be used to restrict relative rotation between uphole housing 202 and downhole valve body 280.

Uphole valve body 250 is positioned axially adjacent downhole valve body 280 whereby the downhole contact face 268 of uphole valve body 250 may contact the uphole contact face 294 of downhole valve body 280. In some embodiments, a metal-to-metal sealing interface 275 (shown in FIG. 3B) is formed between the portion of downhole contact face 268 of uphole valve body 250 that is in contact with the uphole contact face 294 of downhole valve body 280 whereby fluid communication is restricted across the sealing interface 275. In this exemplary embodiment, uphole valve body 250 is rotationally locked to rotor 160 of power sub 140 while downhole valve body 280 is rotationally locked to the stator 142 of power sub 140.

Wash pipe 310 of valve sub 200 generally includes a first or uphole end 312, a second or downhole end 314 that is opposite uphole end 312, a central bore or passage 316 extending between ends 312, 314, and a generally cylindrical outer surface 318 also extending between ends 312, 314. In this exemplary embodiment, the uphole end 312 of wash pipe 310 is slidingly received within the central passage 286 of downhole valve body 280 while the downhole end 314 of wash pipe 310 includes an internal connector 320 formed on an inner surface thereof and which connects wash pipe 310 to the shock sub 350. The seal assembly 300 of downhole valve body 280 sealingly engages the outer surface 318 of wash pipe 310 to restrict fluid flow through an annular interface formed between downhole valve body 280 and wash pipe 310. Additionally, in some embodiments, an annular bearing may be positioned radially between downhole valve body 280 and wash pipe 310 to reduce friction therebetween. Further, in this exemplary embodiment, the outer surface 318 of wash pipe 310 comprises a plurality of annular shoulders 322.

Floating piston 330 of valve sub 200 is annular in shape and is positioned radially between wash pipe 310 and downhole housing 230. In this exemplary embodiment, floating piston 330 comprises an annular first or inner seal assembly 332 positioned on an inner surface of floating piston 330 and an annular second or outer seal assembly 334 positioned on an outer surface of floating piston 330. The inner seal assembly 332 sealingly engages the outer surface 318 of wash pipe 310 while the outer seal assembly 334 sealingly engages an inner surface of downhole housing 230. Floating piston 330 is permitted to slide axially relative to wash pipe 310 and downhole housing 230 and, in some embodiments, floating piston 330 may include one or more annular bearings configured to reduce friction between floating piston 330 and wash pipe 310 or downhole housing 230.

Seal assemblies 332, 334 of floating piston 330 (shown in FIG. 8) define a first or uphole section 237 of the central passage 236 of downhole housing 230, and a second or downhole section 239 of central passage 236 which is separate from the uphole section 237. Downhole section 239 of central passage 236 may define a portion of a sealed hydraulic chamber 241 filled with a non-compressible fluid such as hydraulic fluid. At least some of the components of shock sub 350 may be positioned in hydraulic chamber 241. In this configuration, hydraulic chamber 241 is sealed from the environment surrounding friction reduction system 100 by seal assemblies 332, 334 of floating piston 330. However, floating piston 330 allows for the communication of fluid pressure from the surrounding environment, such as pressure from wellbore 3, to hydraulic chamber 241 and at least some of the components of shock sub 350.

As will be discussed further herein, shock sub 350 is configured to translate periodic fluctuations in fluid pressure within hydraulic chamber 241 generated by valve sub 200 into oscillating motion of bottom sub 120 relative top sub 102 of friction reduction system 100. Referring to FIGS. 3A-3C, 8, in this exemplary embodiment, shock sub 350 generally includes a first or uphole housing 352, a second or downhole housing 380, a mandrel 410, and a biasing element 440. The uphole housing 352 of shock sub 350 includes a first or uphole end 354, a second or downhole end 356 that is opposite uphole end 354, and a central bore or passage 358 defined by a generally cylindrical inner surface 359 extending between ends 354, 356. Uphole housing 352 also includes an internal uphole connector 360 at the uphole end 354 thereof and formed on the inner surface 359 of uphole housing 352. Uphole connector 360 may releasably or threadably connect to the downhole connector 240 of the downhole housing 230 of valve sub 200. An annular seal assembly may be positioned at the interface formed between the downhole end 234 of downhole housing 230 and the uphole end 354 of the uphole housing 352 of shock sub 350 to seal the connection formed therebetween. In this exemplary embodiment, uphole housing 352 further includes an internal lower connector 362 at the lower end 356 thereof and formed on the inner surface 359 of uphole housing 352. Lower connector 362 may releasably or threadably connect to an uphole end of lower housing 380. Additionally, the inner surface 359 of uphole housing 352 includes an annular shoulder 364 located between ends 354, 356.

Lower housing 380 of shock sub 350 similarly includes a first or uphole end 382, a second or lower end 384 that is opposite uphole end 382, and a central bore or passage 386 extending between ends 382, 384. Lower housing 380 also includes an external uphole connector 388 at the uphole end 382 thereof and formed on an outer surface of lower housing 380. Uphole connector 388 may releasably or threadably connect to the lower connector 362 of uphole housing to couple together housings 352, 380 of shock sub 350. An annular seal assembly may be positioned at the interface formed between the lower end 356 of uphole housing 352 and the uphole end 382 of lower housing 380 to seal the connection formed therebetween. Lower housing 380 further includes an annular seal assembly 390 located at the lower end 384 and configured to sealingly engage an outer surface of bottom sub 120. In this configuration, hydraulic chamber 241 may extend between floating piston 330 and the seal assembly 390 of lower housing 380. While in this exemplary embodiment shock sub 350 comprises separate housings 352, 380 which may be coupled together, in other embodiments, shock sub 350 may include a single, integrally or monolithically formed housing.

Mandrel 410 of shock sub 350 generally includes a first or uphole end 412, a second or lower end 414, a central bore or passage 416 extending between ends 412, 414. Mandrel 410 includes an external uphole connector 418 located at the uphole end 412 thereof and formed on an outer surface of mandrel 410. Uphole connector 418 of mandrel 410 may releasably or threadably connect mandrel 410 to the lower connector 320 of the wash pipe 310 of valve sub 200 whereby relative axial movement between wash pipe 310 and mandrel 410 is restricted. Additionally, an annular seal assembly 420 is positioned radially between the uphole end 412 of mandrel 410 and the lower end 314 of wash pipe 310 to seal the annular interface formed therebetween. Mandrel 410 also includes an internal lower connector 422 located at the lower end 414 thereof and formed on an inner surface of mandrel 410. Lower connector 422 of mandrel 410 may releasably or threadably connect mandrel 410 to the uphole connector 128 of bottom sub 120 whereby relative axial movement between mandrel 410 and bottom sub 120 is restricted. In this configuration, bottom sub 120 is axially locked to the wash pipe 310 by mandrel 410 whereby bottom sub 120 travels axially in concert with wash pipe 310. Additionally, another annular seal assembly 424 is positioned radially between the lower end 414 of mandrel 410 and the uphole end 122 of bottom sub 120 to seal the annular interface formed therebetween. While in this embodiment mandrel 410 and bottom sub 120 comprise separate components, in other embodiments, mandrel 410 and bottom sub 120 may comprise a single, integrally or monolithically formed mandrel. Thus, bottom sub 120 may also comprise a mandrel of friction reduction system 100.

Biasing element 440 is configured to bias wash pipe 310 (and thus mandrel 410 and bottom sub 120 connected therewith in a first or uphole axial direction (indicated by arrow 442 in FIG. 3C) and, in this exemplary embodiment, extends axially between an annular contact plate 444 and the shoulder 364 of uphole housing 352. Contact plate 444 may contact both an uphole end of biasing element 440 and the lower end 314 of wash pipe 310. In this exemplary embodiment, biasing element 440 comprises a plurality of Bellville washers or springs; however, in other embodiments, the configuration of biasing element 440 may vary. For example, in other embodiments, biasing element 440 may comprise other forms of mechanical biasing elements or other forms of biasing elements such as biasing elements comprising compressible fluids.

During operation of friction reduction system 100 pressurized drilling fluid 40 may be pumped from supply pump 44 through drillstring 24, and into the top sub 102 of friction reduction system 100. A first portion of the drilling fluid 40 entering friction reduction system 100 flows along first flowpath 180 through central passage 168 of rotor 160, and into and through rotor nozzle 177 of power sub 140. A second portion, distinct from the first portion, of the drilling fluid 40 entering friction reduction system 100 flows along second flowpath 182 and into a first set of open cavities 178 formed between stator 142 and rotor 160. The flow of pressurized drilling fluid along second flowpath 182 induces rotation of rotor 160 about central axis 175 relative stator 142. The rate of rotation of rotor 160 about central axis 175 is dependent on the amount of drilling fluid 40 diverted to the second flowpath 182. In turn, the amount of drilling fluid 40 diverted to the second flowpath relative to the amount of drilling fluid 40 flowing along first flowpath 180 may be controlled by the degree of flow restriction affected by rotor nozzle 177. Thus, the rate of rotation of rotor 160 may be controlled based on the pressure or flowrate of drilling fluid 40 outputted by inlet pump 44 and by the flow restriction (for example, orifice size) provided by rotor nozzle 177. As will be described further herein, the frequency of the oscillatory movement induced by friction reduction system 100 may be controlled by controlling the rate of rotation of rotor 160.

Additionally, as described previously, if desired dart 172 may be pumped through drillstring 24 and landed within central passage 168 of rotor 160. The landing of dart 172 within rotor 160 positions dart nozzle 174 along first flowpath 180 and thereby provides an additional flow restriction along first flowpath 180. The additional flow restriction provided by dart nozzle 174 increases the amount of drilling fluid 40 flowing along second flowpath 182 relative to first flowpath 180 and thereby increases the rotational rate of rotor 160 at a given flow rate of drilling fluid 40 entering power sub 140. The increase in the rotational rate of rotor 160 may increase the frequency of the oscillation induced in drillstring 24 by friction reduction system 100. An increase in the frequency of oscillation induced by friction reduction system 100 may be advantageous in scenarios where the drillstring 24 enters a portion of the wellbore 3 surrounded by subsurface formations which differ in one or more properties from previously drilled sections of wellbore 3.

Referring to FIGS. 17-20, being rotationally locked to rotor 160, uphole valve body 250 also rotates about central axis 175 relative lower valve body 280 which is held stationary relative to stator 142. Thus, the relative rotation between uphole valve body 250 and lower valve body 280 corresponds to the rotational rate of rotor 160 relative to stator 142. As uphole valve body 250 rotates relative to lower valve body 280, the bypass passages of uphole valve body 250 enter into and out of circumferential alignment or overlap with the bypass passages 298 of lower valve body 280. Particularly, valve bodies 250, 280 of valve sub 200 combine to form or define a rotary valve 255 having a first or open configuration (shown in FIGS. 17, 19) and a second or closed configuration (shown in FIGS. 18, 20). In the open configuration of rotary valve 255, fluid communication is provided between bypass passages 270 of uphole valve body 250 and the bypass passages 298 of lower valve body 280. However, when rotary valve 255 is in the closed communication, fluid communication is restricted between bypass passages 270 and bypass passages 298 by the sealing interface 275 formed between valve bodies 250, 280. With uphole valve body 250 rotating relative to lower valve body 280, rotary valve 255 cyclically actuates between the open and closed configurations at a rate that is dependent on the relative rotational speed between uphole valve body 250 and lower valve body 280.

Although in this exemplary embodiment power sub 140 is used to rive the relative rotation of valve bodies 250, 280, in other embodiments, friction reduction system 100 may not include power sub 140 and instead a different mechanism may be utilized for providing relative rotation between valve bodies 250, 280. For example, an electric motor which may be driven by a battery, a generator, may be utilized to drive the rotation of uphole valve body 250. The downhole electric motor may be in communication with a downhole sensor package configured to determine the axial displacement of bottom sub 120. The electric motor may be controlled by a controller to achieve a desired magnitude or frequency of axial displacement of bottom sub 120 using the sensor package by adjusting the rotational rate of uphole valve body 250 relative to lower valve body 280.

When rotary valve 255 is in the open configuration, a first portion of the drilling fluid 40 flowing along second flowpath 182 flows along a third flowpath 184 (shown in FIG. 7) extending from second flowpath 182 and which enters the bypass passages 270 of uphole valve body 250, extends through the bypass passages 298 of lower valve body 280 and into the uphole section 237 of the central passage 236 of lower housing 230 which is otherwise filled with fluid from wellbore 3. The drilling fluid 40 flowing along third flowpath 184 is generally at a higher pressure than the wellbore fluid otherwise filling uphole section 237. For example, the pressure differential in at least some applications between the drilling fluid 40 and the wellbore fluid may be one or more thousands of pounds per square inch (PSI). The drilling fluid 40 flowing along third flowpath 184, being at a higher pressure than the wellbore fluid within section 237, may thus eject some of the wellbore fluid from uphole section 237, through nozzle 216 and into the wellbore 3. In addition to wellbore fluid, a small, controlled amount of drilling fluid 40 may also be ejected through nozzle 216 and into wellbore 3. In other embodiments, friction reduction system 100 may not include nozzle 216. Additionally, the pressure of drilling fluid 40 flowing along third flowpath 184 is communicated to hydraulic chamber 241 via floating piston 330. The metering provided by nozzle 216 may ensure the pressure of the drilling fluid is applied to floating piston 330 rather than being lost to the wellbore 3.

Also, when rotary valve 255 is in the open configuration, a second portion of the drilling fluid 40 flowing along second flowpath 182 flows along a fourth flowpath 186 (shown in FIG. 7) extending from second flowpath 182 and which enters the central passage 256 of uphole valve body 250 via radial ports 262, extends through the central passage 286 of lower valve body 280 and into the central passage 316 of wash pipe 310. The drilling fluid 40 flowing along fourth flowpath 186 exits friction reduction system 100 via the central passage 126 of bottom sub 120 where the drilling fluid 40 may be communicated to downstream components such as the portion of drillstring 24 positioned downstream from friction reduction system 100 and the BHA 30 connected to the end of drillstring 24.

When rotary valve 255 is in the closed configuration, drilling fluid 40 flowing along second flowpath 182 is restricted from entering the uphole section 237 of the central passage 236 of lower housing 230 by the sealing interface 275 formed between uphole valve body 250 and lower valve body 280. In the closed configuration of rotary valve 255, the pressure of drilling fluid 40 is not communicated to uphole section 237 which remains at wellbore pressure.

Thus, in the closed configuration of rotary valve 255, hydraulic chamber 241 is maintained at wellbore pressure which is substantially less than the pressure of drilling fluid 40 flowing through friction reduction system 100. Instead of a portion of the drilling fluid 40 being directed along third flowpath 184, all or substantially all of the drilling fluid 40 flowing along second flowpath 182 is communicated to the fourth flowpath 184 entering the central passage 316 of wash pipe 310.

As described previously, hydraulic chamber 241 is disposed at a first or drilling fluid pressure when rotary valve 255 is in the open configuration and at a second or wellbore pressure when rotary valve 255 is in the closed configuration, wherein the drilling fluid pressure is greater than the wellbore pressure. Also, as described previously, rotary valve 255 cyclically actuates between the open and closed configurations in response to the rotation of uphole valve body 250 relative to lower valve body 280. Thus, pressure within hydraulic chamber 241 cyclically fluctuates between the relatively greater drilling fluid pressure and the relatively lower wellbore pressure.

In this exemplary embodiment, the cyclical fluctuation in pressure of hydraulic chamber 241 acts against mandrel 410 and bottom sub 120 to drive the axial oscillation of bottom sub 120. Particularly, pressure within hydraulic chamber 241 is applied against an axially-projected first annular pressure area associated with mandrel 410 and bottom sub 120 that corresponds in size to the axially-projected annular area of the segment of wash pipe 310 contacted by seal assembly 300. Pressure within hydraulic chamber 241 acts against the first pressure area in a second axial direction (indicated by arrow 446 in FIG. 8) that is opposite the first axial direction 442 while wellbore pressure (significantly less in magnitude than the pressure within hydraulic chamber 241 generated by drilling fluid 40) acts against an axially-projected second annular pressure area corresponding in size to the axially-projected annular area of the segment of bottom sub 120 contacted by seal assembly 390.

The net pressure force applied to mandrel 410 and bottom sub 120 in the second axial direction 446 by pressure within hydraulic chamber 241 resists a biasing force applied by biasing element 440 against mandrel 410 and bottom sub 120 in the first axial direction 442. In this exemplary embodiment, the net pressure force applied to mandrel 410 and bottom sub 120 when rotary valve 255 is in the closed configuration (where pressure within hydraulic chamber 241 corresponds to the wellbore pressure) is at or near zero given that wellbore pressure is applied to both the first pressure area and the second pressure area when rotary valve 255 is in the closed configuration. Thus, a net force in the first axial direction 442 corresponding to the biasing force applied by biasing element 440 is applied to mandrel 410 and bottom sub 120 when rotary valve 255 is in the closed configuration. Conversely, the net pressure force applied to mandrel 410 and bottom sub 120 when rotary valve 255 is in the open configuration (where pressure within hydraulic chamber 241 corresponds to the drilling fluid pressure) is greater than the opposing biasing force applied to mandrel 410 and bottom sub 120 by biasing element 440. The net pressure force corresponding to the application of drilling fluid pressure against mandrel 410 and bottom sub 120 may be referred to herein as a first net pressure force while the net pressure force corresponding to the application of wellbore pressure against mandrel 410 and bottom sub 120 may be referred to herein as a second net pressure force which is less than the first net pressure force.

The first net pressure force, being greater than the biasing force applied by biasing element 440, strokes mandrel 410 (along with bottom sub 120 connected thereto) in the second axial direction when rotary valve 255 is in the open configuration. To state in other words, a first net pressure force is applied to the mandrel 410 corresponds to a drilling fluid pressure of a drilling fluid 40 and is applied in response to flowing the drilling fluid through 40 the valve and transitioning the rotary valve 255 from the closed configuration to the open configuration. Conversely, the biasing force applied by biasing element 440, being greater than the second pressure force, strokes mandrel 410 (along with bottom sub 120 connected thereto) in the first axial direction 442 when rotary valve 255 is in the closed configuration. To state in other words, a second net pressure force is applied against the mandrel 410 that corresponds to a wellbore fluid pressure in response to flowing the drilling fluid 40 through the rotary valve 255 and transitioning the valve 255 from the open configuration to the closed configuration. In this manner, mandrel 410 and bottom sub 120 oscillate back and forth along axial directions 442, 446 in response to the cyclical actuation of rotary valve 255 between the closed and open configurations.

In the manner described above, valve sub 200 of friction reduction system 100 may induce axial oscillatory movement in the bottom sub 120 and the drillstring 24 coupled therewith without choking or otherwise introducing an obstruction in the flow of drilling fluid 40 through friction reduction system 100 and thereby minimizing the pressure drop in the drilling fluid 40 across friction reduction system 100. Particularly, in this exemplary embodiment, instead of choking the flow of drilling fluid 40 to create pressure pulse for inducing oscillatory movement, valve sub 200 is configured to divert a small, controlled amount of drilling fluid 40 to the surrounding environment (for example, wellbore 3) and thereby leverage the substantial pressure differential between the drilling fluid 40 and the wellbore fluid to drive oscillation of bottom sub 120. Indeed, the pressure differential between the drilling fluid 40 and the wellbore fluid may be substantially greater than the pressure differential achievable from cyclically choking the flow of drilling fluid 40, thereby enhancing the performance of friction reduction system 100 (for example, maximizing the amplitude of axial displacement of bottom sub 120) relative to friction reducers which rely on choking a flow of drilling fluid.

Additionally, in this exemplary embodiment, the loss of a controlled amount of drilling fluid 40 to the surrounding environment (for example, wellbore 3) reduces the flowrate of drilling fluid 40 downstream of friction reduction system 100. The reduction in flowrate of the drilling fluid 40 downstream of friction reduction system 100 reduces the amount of friction pressure loss in the drilling fluid 40 as it flows towards the BHA 30. In this manner, the pressure drop in the drilling fluid 40 across friction reduction system 100 (for example, from driving rotor 160 of power sub 140) are at least partially if not fully offset by a reduction in pressure drop across the portion of the drillstring 24 connected between friction reduction system 100 and BHA 30.

Figure 21:
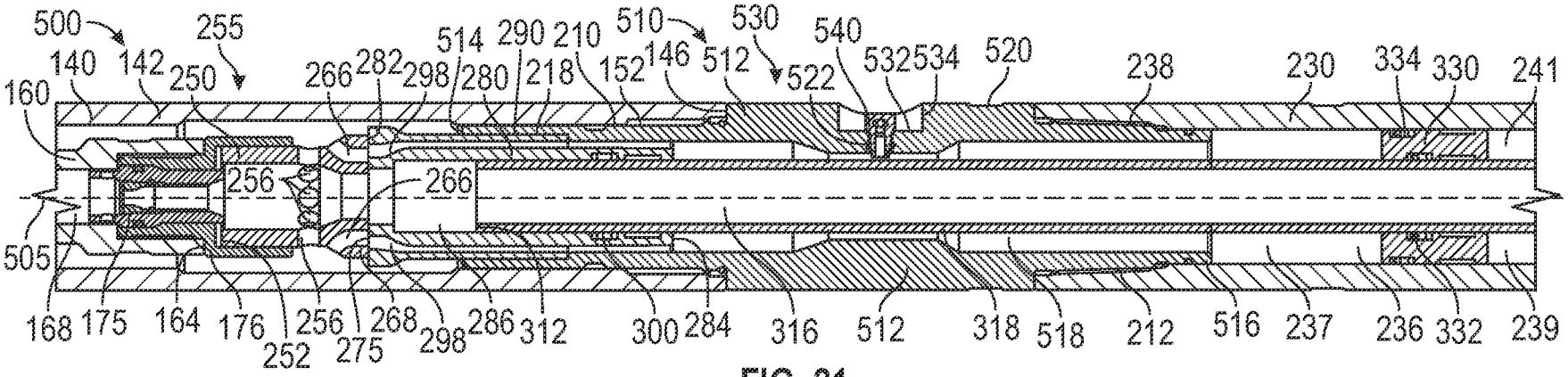
FIG. 21 is a side cross-sectional view of an uphole section of another embodiment of a friction reduction system.
Figure 23:
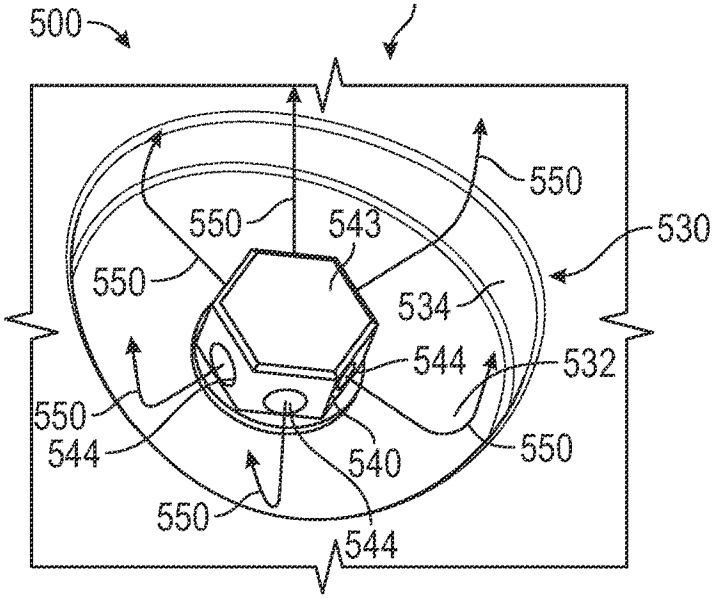
FIG. 23 is a zoomed-in perspective view of the diffuser of the friction reduction system of FIG. 21.
Figure 22:
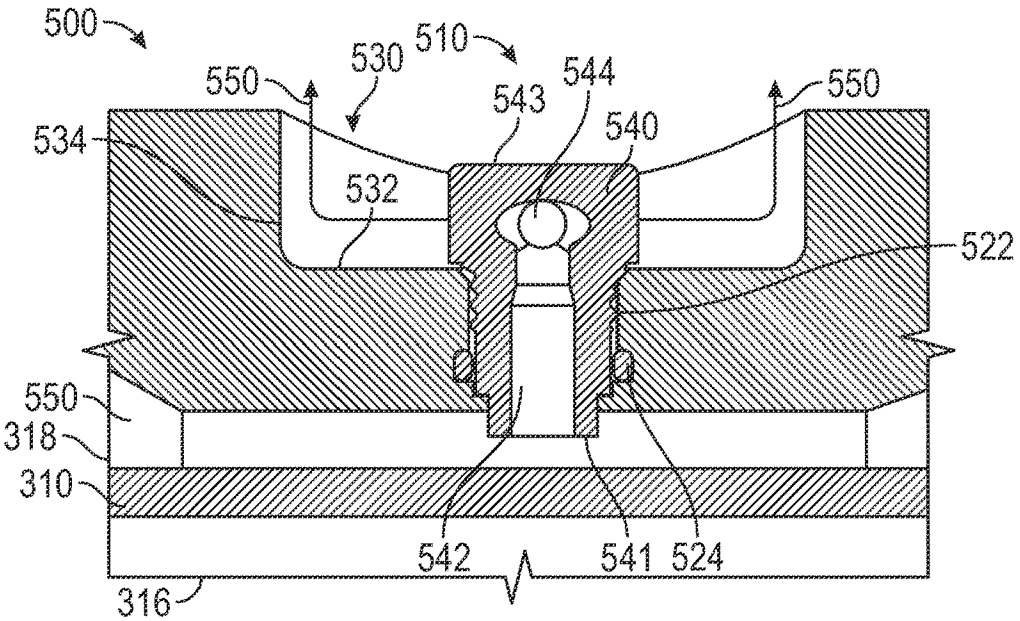
FIG. 22 is a zoomed-in side cross-sectional view of an embodiment of a diffuser of the friction reduction system of FIG. 21.

Referring to FIGS. 21-23, another embodiment of a friction reduction system 500 is shown. Friction reduction system 500 includes features in common with the friction reduction system 100 shown in FIGS. 3A-20, and shared features are labeled similarly.

In this exemplary embodiment, friction reduction system 500 has a central or longitudinal axis 505 and generally includes top sub 102 (not shown in FIGS. 21-23), bottom sub 120 (not shown in FIGS. 21-23), power sub 140, shock sub 350 (not shown in FIGS. 21-23), and a valve sub or section 510. It may be understood that in other embodiments the configuration of friction reduction system 500 may vary and, for example, system 500 may not include top sub 102, bottom sub 120, power sub 140, or shock sub 350, and may also include additional components not shown in FIGS. 21-23.

In this exemplary embodiment, the valve sub 510 of friction reduction system 500 is similar to valve sub 200 described above except that valve sub 510 includes an uphole housing 512 which varies in configuration from the uphole housing 202 of the valve sub 200 described above. Uphole housing 512 of valve sub 510 includes a first or uphole end 514, a second or lower end 516 that is opposite uphole end 514, a central bore or passage 518 extending between ends 514, 516, and a generally cylindrical outer surface 520 extending between ends 514, 516. Similar to the valve sub 200 described above, the uphole connector 210 of uphole housing 512 may releasably or threadably connect to the lower connector 152 of stator 142 to couple valve sub 510 with power sub 140. Additionally, lower connector 212 may releasably or threadably connect to an uphole end of the lower housing 230 of valve sub 510.

Uphole housing 512 of valve sub 510 includes a radial port 522 providing fluid communication between the central passage 518 of uphole housing 512 and the surrounding environment (for example, the wellbore). In this exemplary embodiment, a pocket or scallop 530 is formed on the outer surface 520 of uphole housing 512 where the radial port 522 extends radially from the central passage 518 of uphole housing 512 to the scallop 530. Scallop 530 extends perpendicularly and radially with respect to central axis 505 and is defined by a recessed interior surface or bottom 532 and a continuous sidewall 534 which entirely surrounds and extends perpendicularly from the bottom 532.

In this exemplary embodiment, in lieu of nozzle 216 described above, a diffuser 540 is received in, and secured to, the radial port 522 of uphole housing 512. A generally cylindrical interface formed between an outer surface of diffuser 540 and an inner surface of the radial port 522 is sealed by an annular seal or O-ring 524 positioned therebetween. In this exemplary embodiment, diffuser 540 is generally cylindrical and has a first or radially inner end 541, a second or radially outer end 543 that is opposite inner end 541 and positioned within the scallop 530, and includes a central inlet passage or fluid inlet 542 extending into diffuser 540 from a first end 541 thereof. While in this exemplary embodiment at least a portion of the diffuser 540 is positioned in scallop 530, in some embodiments, uphole housing 512 may not include scallop 530 and thus diffuser 540 may not necessarily be positioned within a scallop. Additionally, in this exemplary embodiment, diffuser 540 includes a plurality of side or fluid outlets 544 proximal the outer end 543 of diffuser 540. In this exemplary embodiment, diffuser 540 includes a plurality of circumferentially spaced side outlets; however, it may be understood that in other embodiments diffuser 540 may include only a single side outlet 544.

A discharge flowpath 550 is formed by the diffuser 540 that extend from the central passage 518 of uphole housing 512, into and through the inlet passage 542 of diffuser 540, and from inlet passage 542 into and through the side outlets 544 of diffuser 540. It may be understood that the arrows indicating flowpath 550 are only exemplary and for illustrative purposes. After exiting the side outlets 544, the discharge flowpath 550 extend towards the sidewall 534 of scallop 530, which forces the flowpaths 550 to turn radially outwards from central axis 505 towards the sidewall of the wellbore in which friction reduction system 500 is installed. In this manner, fluid travelling along discharge flowpath 550 from the central passage 518 of uphole housing 512 to the wellbore is forced to make several directional changes before contacting the sidewall of the wellbore. Particularly, fluid travelling along discharge flowpath 550 flows in a radially outwards direction (substantially perpendicular to central axis 505) through the inlet passage 542 of diffuser 540. However, prior to exiting diffuser 540, is forced to flow by diffuser 540 along second directions each of which extend substantially perpendicular to the radially outwards direction and which is generally parallel to the sidewall of the wellbore as the fluid exits diffuser 540 via side outlets 544. As an example, the second directions may extend at angles of 30 degrees or greater relative to the first direction. Thus, fluid travelling along discharge flowpath 550 is forced by diffuser 540 to make an approximately ninety-degree bend from a first radially outwards direction to a second direction orthogonal the radially outwards direction as the fluid is ejected from diffuser 540. Fluid exiting diffuser 540 is thus not directed directly towards the direction of the sidewall of the wellbore, and is instead ejected in a direction extending generally parallel to the sidewall of the wellbore.

After exiting the diffuser 540, the fluid flows in the second or parallel directions until the fluid is forced again to make an approximately ninety-degree direction change by the sidewall 534 of scallop 530. Particularly, the fluid travelling along discharge flowpath 550 is forced from the parallel direction to a second radially outwards direction extending towards the sidewall of the wellbore. Additionally, the velocity of the flow of fluid is further reduced as the fluid exits diffuser 540 by dividing the flow of fluid along discharge flowpath 550 from a single inlet passage 542 to a plurality of separate side outlets 544. It may be understood that in some embodiments, the sidewall 534 or bottom 532 of the scallop 530 is coated with an erosion-resistant material, such as a hardened material, to resist erosion in response to contact with the fluid flowing along discharge flowpath 550.

While the fluid flowing along discharge flowpath 550 eventually contacts the sidewall of the wellbore, the directional changes made by the fluid as it flows along the discharge flowpath 550 decelerates or reduces a velocity of the fluid before the fluid contacts the sidewall of the wellbore. For example, the change of direction of the fluid as it flows from the inlet passage 542 of diffuser 540 to the side outlets 544 thereof reduces the velocity of the fluid exiting the diffuser 540. The reduction in velocity of the fluid in-turn reduces or eliminates any damage or washout that may otherwise occur to the sidewall of the wellbore in response to contact from the fluid ejected from valve sub 510. The reduction in velocity of the fluid provided by diffuser 540 may thus help preserve the integrity of the mud cake formed along the sidewall of the wellbore. As described previously, the mud cake of the wellbore provides a physical barrier between the wellbore and the surrounding earthen formation that reduces loss of wellbore fluids to the earthen formation. Thus, by preserving the mud cake of the wellbore through reducing the velocity of the fluid discharged from valve sub 510, the amount of wellbore fluid (for example, drilling fluid) lost to the earthen formation may be minimized.

While disclosed embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A friction reduction system deployable in a wellbore, comprising:

a housing comprising a central axis and a central passage;

a valve disposed in the housing and comprising a first valve body and a second valve body wherein the first valve body is permitted to rotate relative to the second valve body; and a mandrel coupled to the second valve body and permitted to travel axially relative to the housing;

wherein a first net pressure force generated by a pressure of a drilling fluid is applied against the mandrel in response to flowing the drilling fluid through the valve and transitioning the valve from a closed configuration to an open configuration; and wherein a second net pressure force generated by a pressure of wellbore fluid in an annulus formed in the wellbore surrounding the housing is applied against the mandrel in response to flowing the drilling fluid through the valve and transitioning the valve from the open configuration to the closed configuration.

2. The friction reduction system of claim 1, wherein the valve is configured to stroke the mandrel in a first axial direction in response to applying the first net pressure force against the mandrel when in the open configuration.

3. The friction reduction system of claim 2, further comprising a biasing element configured to stroke the mandrel in a second axial direction that is opposite the first axial direction when the valve is in the closed configuration.

4. The friction reduction system of claim 1, further comprising:

a stator comprising a plurality of helical stator lobes and coupled to both the housing and the second valve body such that rotation between the stator and the second valve body is restricted; and a rotor comprising a plurality of helical rotor lobes and rotatably disposed in the stator, wherein the rotor is coupled to the first valve body such that relative rotation between the rotor and the first valve body is restricted.

5. The friction reduction system of claim 4, further comprising:

a first flowpath extending through a central passage formed in the rotor;

a second flowpath extending through a set of cavities formed between the stator lobes and the rotor lobes; and a nozzle positioned along the first flowpath;

wherein the nozzle is configured to control an amount of fluid flowing along the second flowpath relative to an amount of fluid flowing along the first flowpath.

6. The friction reduction system of claim 5, further comprising a flow-transportable dart configured to land within the central passage of the rotor to increase the amount of fluid flowing along the second flowpath relative to the amount of fluid flowing along the first flowpath.

7. The friction reduction system of claim 1, wherein a central passage and a bypass passage offset from the central passage are each formed in the first valve body.

8. The friction reduction system of claim 7, wherein:

fluid communication is permitted between the bypass passage of the first valve body and the bypass passage of the second valve body when the valve is in the open configuration; and fluid communication is restricted between the bypass passage of the first valve body and the bypass passage of the second valve body when the valve is in the closed configuration.

9. The friction reduction system of claim 1, wherein:

a first flowpath is formed when the valve is in both the open configuration and the closed configuration and which extends through a radial port of the first valve body and into a central passage of the mandrel; and a second flowpath is formed when the valve is in the open configuration but not in the closed configuration and which extends through both a bypass passage of the first valve body and a bypass passage of the second valve body.

10. The friction reduction system of claim 1, further comprising:

a diffuser coupled to the housing such that a flowpath is provided between the central passage of the housing and an environment surrounding the housing, wherein the diffuser has a fluid inlet and a plurality of fluid outlets greater in number than the fluid inlet.

11. The friction reduction system of claim 1, wherein:

a scallop is formed in an outer surface of the housing and is configured with both a bottom and a continuous sidewall surrounding the bottom; and the friction reduction system further comprises a diffuser coupled to the housing and at least partially received in the scallop;

wherein the diffuser provides a flowpath between the central passage of the housing and an environment surrounding the housing.

12. The friction reduction system of claim 1, further comprising:

a diffuser coupled to the housing such that a flowpath is provided between the central passage of the housing and an environment surrounding the housing;

wherein the flowpath extends in a first, radially outwards direction through a fluid inlet of the diffuser and in a second direction through a fluid outlet of the diffuser that is at an angle of greater than thirty degrees from the first direction.

13. A friction reduction system deployable in a wellbore, comprising:

a housing comprising a central axis and a central passage;

a valve disposed in the housing and comprising a first valve body defining a bypass passage and a second valve body having a radially outer surface extending between a first end and a second end of the second valve body and a radially inner surface extending between the first end and the second end of the second valve body, wherein the second valve body defines both a radial port and a bypass passage, the radial port extending from the radially outer surface to the radially inner surface of the second valve body, and wherein the first valve body is permitted to rotate relative to the second valve body; and a mandrel coupled to the second valve body and permitted to travel axially relative to the housing;

wherein a first flowpath is formed in the friction reduction system when the valve is in both an open configuration and a closed configuration, the first flowpath extending through the radial port of the first valve body and into a central passage of the mandrel;

wherein a second flowpath is formed in the friction reduction system when the valve is in the open configuration but not in the closed configuration, the second flowpath extending through both the bypass passage of the first valve body and the bypass passage of the second valve body.

14. The friction reduction system of claim 13, further comprising:

a stator comprising a plurality of helical stator lobes and coupled to both the housing and the second valve body such that rotation between the stator and the second valve body is restricted; and a rotor comprising a plurality of helical rotor lobes and rotatably disposed in the stator;

wherein the rotor is coupled to the first valve body such that relative rotation between the rotor and the first valve body is restricted.

15. The friction reduction system of claim 14, wherein:

the rotor defines a central passage extending therethrough, and wherein a third flowpath extends through the central passage of the rotor;

the stator lobes and the rotor lobes define a set of cavities located between the stator lobes and the rotor lobes, and wherein a fourth flowpath extending through the set of cavities; and the friction reduction system further comprises a nozzle positioned along the third flowpath, wherein the nozzle is configured to control an amount of fluid flowing along the fourth flowpath relative to an amount of fluid flowing along the third flowpath.

16. The friction reduction system of claim 15, further comprising a flow-transportable dart configured to land within the central passage of the rotor to increase the amount of fluid flowing along the second flowpath relative to the amount of fluid flowing along the first flowpath.

17. The friction reduction system of claim 13, wherein the housing comprises a nozzle configured to meter an amount of drilling fluid ejected from the friction reduction system when the valve is in the open configuration.

18. The friction reduction system of claim 13, further comprising:

a biasing member configured to apply a biasing force against the mandrel;

wherein the mandrel is stroked in a first axial direction in response to applying a net pressure force against the mandrel when the valve transitions from the closed configuration to the open configuration; and wherein the biasing member is configured to stroke the mandrel in a second axial direction that is opposite the first axial direction when the valve is in the closed configuration.

19. The friction reduction system of claim 13, wherein:

the valve is configured to apply a first net pressure force against the mandrel that corresponds to a drilling fluid pressure when in the open configuration; and the valve is configured to apply a second net pressure force against the mandrel that corresponds to a wellbore fluid pressure when in the closed configuration.

20. The friction reduction system of claim 13, further comprising:

a diffuser coupled to the housing such that a discharge flowpath is provided between the central passage of the housing and an environment surrounding the housing;

wherein the diffuser has a fluid inlet and a plurality of fluid outlets greater in number than the fluid inlet.

21. The friction reduction system of claim 13, wherein:

a scallop is formed in an outer surface of the housing and is configured with both a bottom and a continuous sidewall surrounding the bottom; and the friction reduction system further comprises a diffuser coupled to the housing and at least partially received in the scallop, wherein the diffuser provides a discharge flowpath between the central passage of the housing and an environment surrounding the housing.

22. The friction reduction system of claim 13, further comprising:

a diffuser coupled to the housing such that a discharge flowpath is provided between the central passage of the housing and an environment surrounding the housing;

wherein the discharge flowpath extends in a first, radially outwards direction through a fluid inlet of the diffuser and in a second direction through a fluid outlet of the diffuser that is at an angle of greater than thirty degrees from the first direction.

23. A friction reduction system deployable in a wellbore, comprising:

a housing comprising a central axis and defining a central passage extending through the housing;

a valve disposed in the housing and comprising a first valve body and a second valve body, wherein the first valve body is permitted to rotate relative to the second valve body;

a mandrel coupled to the second valve body and permitted to travel axially relative to the housing; and a biasing member configured to apply a biasing force against the mandrel;

wherein the mandrel is stroked in a first axial direction in response to applying a first net pressure force generated by a drilling fluid against the mandrel when the valve is transitioned from a closed configuration to an open configuration, wherein the first net pressure force is generated by a drilling fluid flowing through the valve; and wherein the biasing member is configured to stroke the mandrel in a second axial direction that is opposite the first axial direction when the valve is transitioned from the open configuration to the closed configuration whereby a second net pressure force is applied against the mandrel, wherein the second net pressure force is generated by wellbore fluid in an annulus formed in the wellbore surrounding the housing.

24. The friction reduction system of claim 23, further comprising:

a stator comprising a plurality of helical stator lobes and coupled to both the housing and the second valve body such that rotation between the stator and the second valve body is restricted; and a rotor comprising a plurality of helical rotor lobes and rotatably disposed in the stator;

wherein the rotor is coupled to the first valve body such that relative rotation between the rotor and the first valve body is restricted.

25. The friction reduction system of claim 24, further comprising:

a third flowpath extending through a central passage formed in the rotor;

a fourth flowpath extending through a set of cavities formed between the stator lobes and the rotor lobes; and a nozzle positioned along the third flowpath;

wherein the nozzle is configured to control an amount of fluid flowing along the fourth flowpath relative to an amount of fluid flowing along the third flowpath.

26. The friction reduction system of claim 23, wherein the housing comprises a nozzle configured to meter an amount of drilling fluid ejected from the friction reduction system when the valve is in the open configuration.

27. The friction reduction system of claim 23, wherein:

a first flowpath is formed when the valve is in both the open configuration and the closed configuration and which extends through a radial port of the first valve body and into a central passage of the mandrel; and a second flowpath is formed when the valve is in the open configuration but not when the valve is in the closed configuration and which extends through both a bypass passage of the first valve body and a bypass passage of the second valve body.

28. The friction reduction system of claim 23, wherein:

the valve is configured to apply the first net pressure force against the mandrel that corresponds to a drilling fluid pressure when in the open configuration; and the valve is configured to apply the second net pressure force against the mandrel that corresponds to a well-bore fluid pressure when in the closed configuration.

29. The friction reduction system of claim 23, further comprising:

a diffuser coupled to the housing such that a flowpath is provided between the central passage of the housing and an environment surrounding the housing, wherein the diffuser has a fluid inlet and a plurality of fluid outlets greater in number than the fluid inlet.

30. The friction reduction system of claim 23, wherein:

a scallop is formed in an outer surface of the housing, where the scallop is configured with a bottom and a continuous sidewall surrounding the bottom; and the friction reduction system further comprises a diffuser coupled to the housing and at least partially received in the scallop;

wherein the diffuser provides a flowpath between the central passage of the housing and an environment surrounding the housing.

31. The friction reduction system of claim 23, further comprising:

a diffuser coupled to the housing such that a flowpath is provided between the central passage of the housing and an environment surrounding the housing;

wherein the flowpath extends in a first, radially outwards direction through a fluid inlet of the diffuser and in a second direction through a fluid outlet of the diffuser that is at an angle of greater than thirty degrees from the first direction.

* * * * *